US007738813B2

(12) United States Patent
Yasutomi et al.

(10) Patent No.: US 7,738,813 B2
(45) Date of Patent: Jun. 15, 2010

(54) CORONA CHARGER HAVING TWO CHARGING REGIONS

(75) Inventors: Kei Yasutomi, Yokohama (JP); Hitoshi Maruyama, Tokyo (JP); Katsuaki Miyawaki, Yokohama (JP); Takeo Tsukamoto, Yokohama (JP); Masanori Saitoh, Komae (JP); Katsuhiro Aoki, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 249 days.

(21) Appl. No.: 11/941,373

(22) Filed: Nov. 16, 2007

(65) Prior Publication Data

US 2008/0118275 A1 May 22, 2008

(30) Foreign Application Priority Data

Nov. 17, 2006 (JP) ..... 2006-311373

(51) Int. Cl.
*G03G 15/02* (2006.01)

(52) U.S. Cl. ..... 399/171

(58) Field of Classification Search ..... 399/171, 399/170, 172

See application file for complete search history.

(56) References Cited

U.S. PATENT DOCUMENTS

| | | | | |
|---|---|---|---|---|
| 4,876,578 | A * | 10/1989 | Hara et al. | 399/315 |
| 5,424,814 | A | 6/1995 | Suzuki et al. | |
| 5,655,186 | A * | 8/1997 | Godlove et al. | 399/171 |
| 6,163,669 | A | 12/2000 | Aoki et al. | |
| 6,295,437 | B1 | 9/2001 | Hodoshima et al. | |
| 6,788,913 | B1 | 9/2004 | Aoki et al. | |
| 7,099,611 | B2 | 8/2006 | Aoki et al. | |
| 7,639,974 | B2 * | 12/2009 | Kimura et al. | 399/296 |
| 2005/0047829 | A1 * | 3/2005 | Nakane et al. | 399/170 |
| 2005/0175377 | A1 * | 8/2005 | Sakai et al. | 399/266 |

FOREIGN PATENT DOCUMENTS

| | | |
|---|---|---|
| JP | 2-63073 | 3/1990 |
| JP | 5-2988 | 1/1993 |
| JP | 6-202441 | 7/1994 |
| JP | 7-199598 | 8/1995 |
| JP | 8-3673 | 1/1996 |
| JP | 8-64337 | 3/1996 |
| JP | 10-111590 | 4/1998 |
| JP | 2782872 | 5/1998 |
| JP | 3385008 | 12/2002 |
| JP | 3646278 | 2/2005 |
| JP | 2005-202384 | 7/2005 |
| JP | 2006-195192 | 7/2006 |

* cited by examiner

*Primary Examiner*—Quana M Grainger
(74) *Attorney, Agent, or Firm*—Oblon, Spivak, McClelland, Maier & Neustadt, L.L.P.

(57) ABSTRACT

A corona charger includes a case provided in the vicinity of a device to be charged. The case includes an opening facing the device, a discharge electrode, a first charging region, and a second charging region. The discharge electrode provided inside the case and supplied with a voltage so as to generate a corona discharge charges a surface of the device from the opening by supplying the corona discharge to the surface. The first charging region includes no grid electrode at a position upstream of the opening in a surface moving direction of the device. The second charging region includes a grid electrode to which a predetermined voltage is applied at a position downstream of the opening. The voltage applied to the discharge electrode is an alternating current (AC) voltage superimposed on a direct current (DC) voltage.

11 Claims, 10 Drawing Sheets

CORONA CHARGER HAVING TWO CHARGING REGIONS

CROSS-REFERENCE TO RELATED APPLICATIONS

This patent application is based on and claims priority under 35 U.S.C. §119 from Japanese Patent Application No. 2006-311373, filed on Nov. 17, 2006 in the Japan Patent Office, the entire contents of which are hereby incorporated by reference herein.

BACKGROUND OF THE INVENTION

1. Field of the Invention

Exemplary aspects of the present invention generally relate to an image forming apparatus such as a copier, a facsimile, and a printer, and more particularly, to an image forming apparatus including a corona charger.

2. Discussion of the Background

A corotron charger is known as an example of a corona charger. A corotron charger is formed of a metal case made of, for example, aluminum, having a cylindrical shape or a square-cylindrical shape with an open portion.

In substantially a center of the metal case, tungsten wires having a diameter of approximately 50 μm are suspended as a corona electrode.

Direct-current (DC) voltage, alternating current (AC) voltage, or AC voltage superimposed on DC voltage is applied to the corona electrode. DC voltage or ground voltage (0V) is applied to the metal case. When such voltages are applied to the corona electrode and the metal case, a so-called corona discharge occurs.

A device to be charged is disposed facing the opening of the metal case. Ions generated during corona discharge are supplied to the device so that the surface thereof is charged. An advantage of the corotron charger is that its structure can be simple and economical.

However, in order to satisfy growing demand for an electrophotographic device capable of outputting high-quality images, when the corotron charger is used as a charger for charging a photoreceptor serving as an image carrier which carries electrophotography, charge uniformity tends to be difficult to achieve.

For this reason, the corotron charger is less likely to be used as a main charger of the photoreceptor. Instead, the corotron charger is used for purposes such as discharge and adjustment of toner charging polarity.

A scorotron charger including a grid electrode is known as a corona charger having good charge uniformity compared to the corotron charger. The grid electrode is provided between the corona electrode and the photoreceptor as a device to be charged and is supplied with DC voltage or a grid voltage.

The scorotron charger is constructed in such a way that a part of corona discharge flowing from the corona electrode to the photoreceptor is supplied to the grid electrode to which the grid voltage is applied, so that the flow of the corona discharge flowing from the corona electrode to the photoreceptor is controlled. Accordingly, the photoreceptor is charged to a substantially similar if not identical potential as the grid voltage.

Therefore, this structure is advantageous in that it is easy to control the charge potential of the photoreceptor, and to achieve charge uniformity.

In order to maintain the grid electrode at a certain potential, a method in which a constant voltage passive component serving as a self-bias voltage applicator is connected to the grid electrode is known.

Compared to the corotron charger, this type of scorotron charger is advantageous in that the charge potential of the photoreceptor is easy to control.

However, in a case of a direct-current (DC) type scorotron charger, in which DC voltage is applied to the corona electrode, a potential fluctuation of approximately 10 to 50 V is likely to occur due to variations in atmospheric temperature and humidity.

Consequently, charge uniformity is not sufficient, and thus enhancement of charge uniformity is further desired.

In addition, in the scorotron charger, there is corona discharge which flows to the grid electrode rather than to the photoreceptor. Thus, compared to the corotron charger, the scorotron charger is inefficient.

Furthermore, when using the direct-current (DC) type scorotron charger for an extended period of time, the grid electrode is exposed to the corona discharge for an extended period of time. Consequently, the surface of the grid electrode is degraded, and/or a foreign matter adheres to the surface of the grid electrode.

The deterioration of the grid electrode surface causes the voltage to decrease so that the effective voltage of the grid electrode changes, resulting in fluctuation of the charge potential.

Consequently, uniformity of the charge potential of the photoreceptor is not sufficient over time.

In light of the above, use of an alternating-current (AC) type scorotron charger has been considered.

In the AC-type scorotron charger, the grid electrode is provided between the corona electrode and the photoreceptor as a device to be charged and is supplied with DC voltage or a grid voltage. The voltage, including the AC component with AC voltage superimposed on DC voltage, is applied to the corona electrode.

In the AC-type scorotron charger, the above-described drawbacks associated with the DC-type scorotron charger are remedied. Accordingly, a charger with good charge uniformity is achieved.

However, the AC-type scorotron charger has a drawback, in that high-speed charging ability is degraded because positive and negative corona discharges alternatively occur.

High-speed charging ability herein refers to a maximum moving speed of the photoreceptor which the charger can accommodate to charge to a desired charge potential when the traveling speed of the photoreceptor increases. High-speed charging ability may refer to a minimum width of an opening of the charger at which the charger can charge to a desired charge potential.

In order to remedy deterioration of high-speed charging ability in the AC-type scorotron charger, the voltage applied to the charger may be increased, or a width of an opening in the surface moving direction of the photoreceptor may be increased.

However, an increase in the applied voltage may cause the size and the cost of a power source to increase. Consequently, the size and the cost of an entire apparatus may increase accordingly.

Furthermore, when the width of the opening of the charger increases, a ratio of the charger to a circumference of the photoreceptor increases, increasing the size of the apparatus and limiting flexibility of parts allocation and location of devices near the photoreceptor.

In order to rectify the above-described problems, JP-H05-2988-A, for example, proposes a DC/AC double charger consisting of an AC-type scorotron charger connected to a downstream portion of a DC-type corotron or scorotron charger.

According to such a related art charger, the DC-type corotron or scorotron charger charges the photoreceptor to a certain level, and the AC-type scorotron charger evenly charges the photoreceptor. By taking advantage of characteristics of both the AC-type and DC-type chargers, a corona charger which satisfies both high-speed charging ability and the charge uniformity is attained.

However, the DC/AC double charger has a drawback, insofar as the width of opening of the charger further increases. In general, in order to stably generate the corona discharge, it is necessary to dispose the case and the grid electrode 5 to 10 mm away from the discharge electrode in the corona discharge charger.

Consequently, one side of the case needs to have a length of 10 to 20 mm. According to JP-H05-2988-A, two such charges having a similar if not identical size are needed, thereby doubling the space occupied by the two chargers near the photoreceptor.

As a result, such problems may arise as the size of the apparatus increases, and flexibility of parts allocation and the location of devices near the photoreceptor is significantly reduced. Furthermore, when there are more types of applied voltage, the size and the cost of the power source may increase, thereby causing the size and the cost of the entire apparatus to increase as well.

In order to facilitate an understanding of the background art, a description will now be given of an image forming apparatus such as a copier and a printer for a color image using electrophotographic processing that employs the above-described corona charger as a device for charging the photoreceptor.

Various types of image forming apparatuses forming a color image by overlapping a plurality of toner images on a photoreceptor are disclosed, for example, in JP-S63-172286-A, and JP-3646278-B and JP-3385008-B. The process employed by these image forming apparatuses is a so-called photoreceptor color overlapping method.

One example of such an image forming apparatus is equipped with a charger, an exposure unit, a plurality of developing units, a transfer unit, and a cleaning unit disposed around a photoreceptor. In the image forming apparatus, charging, exposure, and development are repeatedly performed for each different color so that a plurality of toner images are overlaid on one another on the same area of the photoreceptor.

Subsequently, the toner images are transferred onto a transfer sheet all at once and are fixed to produce a color image.

The image forming apparatus using the photoreceptor color overlapping method includes a single photoreceptor, and does not use an intermediate transfer member. Thus, the image forming apparatus of this type contributes to space saving and resource reduction.

In the image forming apparatus disclosed in JP-3646278-B, a charger, an exposure portion, and a developing unit are provided for each color around the photoreceptor.

Without rotating the photoreceptor for a number of times, a plurality of colors is overlaid on the photoreceptor. Therefore, the image forming apparatus of this type is advantageous in that high-speed image formation is made possible without reducing image forming speed.

However, in the image forming apparatus disclosed in JP-3646278-B, since the charger, the exposure portion, and the developing unit are provided for each color around the photoreceptor, there is not much room around the photoreceptor. Thus, reduction of the size of the charger is an important issue in order to reduce the space occupied by the charger.

In the image forming apparatus of the photoreceptor color overlapping method, a non-contact type developing unit for a non-contact developing method is used.

In such a non-contact type developing unit for the non-contact developing method, a developer on a toner carrier and a photoreceptor are disposed facing each other in a non-contacting manner so that the toner image formed on the photoreceptor is not distorted during the subsequent developing process, in which a toner image to be overlapped later is developed.

Even if the non-contact developing unit is used, however, the amount of toner to be overlaid on the photoreceptor is reduced due to the toner image already being formed on the photoreceptor, leading to a reduction in the amount of toner to be overlapped.

One cause of this problem may be that the size of the electrical charge in the toner layer formed on the photoreceptor causes the potential after exposure not to decrease as much as the non-toner adhesion area. Consequently, the potential after exposure rises.

In order to solve this problem, JP-2782872-B proposes using a DC/AC-double charger consisting of an AC-type scorotron charger connected to a downstream portion of a DC-type scorotron charger during a process in which the photoreceptor is charged to a desired potential after the toner image of the first color is formed thereon.

In the image forming apparatus, the DC-type scorotron charger of the DC/AC-double charger temporarily charges the photoreceptor to a potential higher than the given potential, and the AC component of the downstream portion of the AC-type scorotron charger reduces the potential to the desired potential. Accordingly, the potential of the toner layer is reduced.

When such a method is used, it is possible to reduce the amount of the electrical charge of the toner layer, and to reduce the reduction in the amount of toner adhered to the toner images overlaid on one anther.

As described above, the AC-type scorotron charger with a large width of the opening and the DC/AC-double charger are effective as chargers that facilitate both high-speed charging ability and charge uniformity. However, the space which the charger occupies is most likely large.

When such a charger is utilized in the image forming apparatus using the photoreceptor color overlapping method as described above, there is less space around the photoreceptor. Therefore, an increase in the size of the charger is a problem.

SUMMARY

In view of the foregoing, exemplary embodiments of the present invention provide an image forming apparatus that includes a corona charger.

In one exemplary embodiment, the corona charger includes a case provided in the vicinity of a device to be charged, including an opening facing the device; a discharge electrode provided inside the case and supplied with a voltage so as to generate a corona discharge, configured to charge a surface of the device from the opening by supplying the corona discharge to the surface; a first charging region including no grid electrode at a position upstream of the opening in a surface moving direction of the device; and a second charging region including a grid electrode to which a predetermined voltage is applied at a position downstream of the opening, with the voltage applied to the discharge electrode being an alternating current (AC) voltage superimposed on a direct current (DC) voltage.

Another exemplary embodiment provides a corona charger that includes a case provided in the vicinity of the device to be charged. The case includes an opening facing the device, a discharge electrode, a first charging region, and a second charging region. The discharge electrode provided inside the case and supplied with a voltage so as to generate a corona discharge charges a surface of the device from the opening by supplying the corona discharge to the surface. The first charging region includes a first grid electrode to which a predetermined voltage is applied at a position upstream of the opening in the surface moving direction of the device and charged to a first grid potential (Vg1). The second charging region includes a second grid electrode to which a predetermined voltage is applied at a position downstream of the opening and charged to a second grid potential (Vg2) substantially near a target charge potential of the device. The voltage applied to the discharge electrode is an alternating current (AC) voltage superimposed on a direct current (DC) voltage.

Yet another exemplary embodiment provides an image forming apparatus including an image carrier, a plurality of chargers, an exposure unit, a plurality of developing units including a toner carrier and a transfer unit. The toner carrier bears a toner image. The plurality of chargers charges the image carrier. The exposure unit exposes the image carrier to form an electrostatic latent image thereon. The plurality of developing units develops a plurality of electrostatic latent images on the image carrier to form a plurality of toner images superimposed one on another. The transfer unit transfers the overlaid toner images on the image carrier to a transfer medium all at once. At least one of the chargers is the first corona charger described above.

In yet another and further exemplary embodiment, a toner carrier includes a plurality of electrodes and a power source. The plurality of electrodes is provided at predetermined intervals. The power source applies a multi-phase voltage to the electrodes so as to form a progressing wave electrical field. The toner carrier bears the toner by way of the progressing wave electrical field and transports the toner to a position opposite the image carrier.

In still yet another and further exemplary embodiment, the toner carrier bears the toner in a nonstatic state by way of the oscillating electrical field, and transports the toner to the position opposite the image carrier by moving the surface.

Additional features and advantages of the present invention will be more fully apparent from the following detailed description of exemplary embodiments, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description of exemplary embodiments when considered in connection with the accompanying drawings, wherein.

DETAILED DESCRIPTION OF EXEMPLARY EMBODIMENTS

Figure 1:
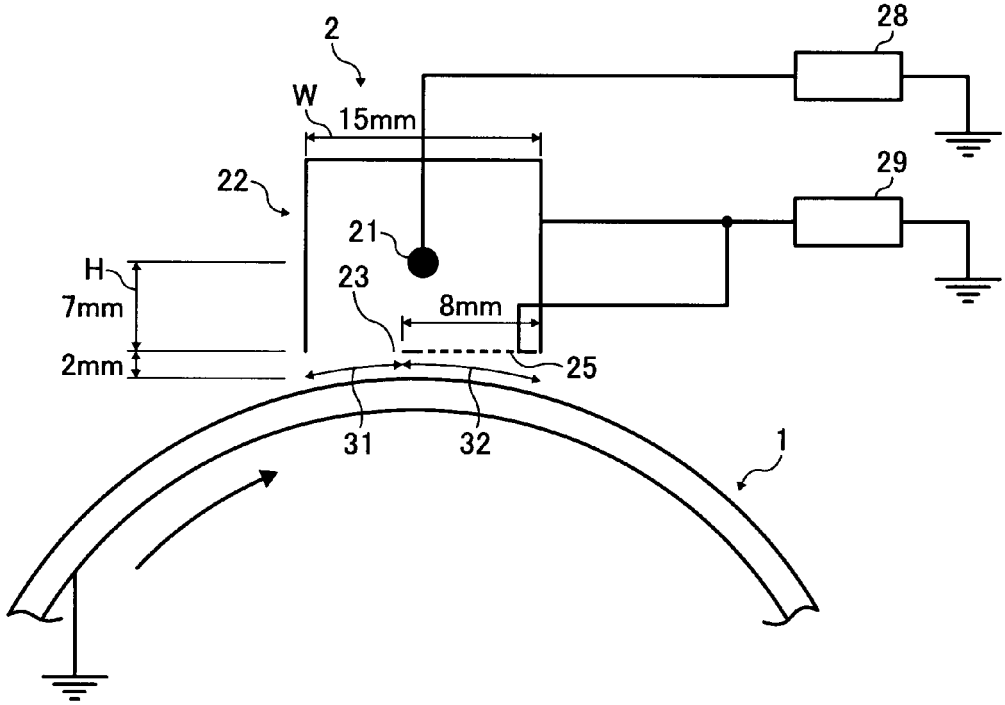
FIG. 1 is a cross-sectional view illustrating a corona charger used in a full-color image forming apparatus, according to a first exemplary embodiment of the present invention.

It will be understood that if an element or layer is referred to as being "on," "against," "connected to" or "coupled to" another element or layer, then it can be directly on, against connected or coupled to the other element or layer, or intervening elements or layers may be present.

In contrast, if an element is referred to as being "directly on", "directly connected to" or "directly coupled to" another element or layer, then there are no intervening elements or layers present. Like numbers refer to like elements throughout.

As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures.

It will be understood that the spatially relative terms are intended to encompass different orientations of the device in use or operation in addition to the orientation depicted in the figures.

For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms.

These terms are used only to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Exemplary embodiments of the present invention are now explained below with reference to the accompanying drawings.

In later-described comparative examples, exemplary embodiments, and alternative examples, solely for the sake of simplicity of drawings and descriptions the same reference characters will be given to constituent elements such as parts and materials having the same functions, and descriptions thereof will be omitted unless otherwise stated.

Typically, but not necessarily, paper is the medium from which is made a sheet on which an image is to be formed. However, other printable media is available in sheets and their use here is included.

For simplicity, this description refers to paper, sheets thereof, paper feeder, etc. It should be understood, however, that the sheets, etc., are not limited only to paper.

Referring now to the drawings, wherein like reference characters designate identical or corresponding parts throughout the several views thereof, and particularly to FIG. 1, a structure of a corona charger employed in a full-color image forming apparatus according to an exemplary embodiment of the present invention is described.

First Exemplary Embodiment

Referring now to FIG. 1, there is shown a cross-sectional view illustrating a structure of a corona charger 2 employed in the full-color image forming apparatus, according to the exemplary embodiment of the present invention.

Figure 2:
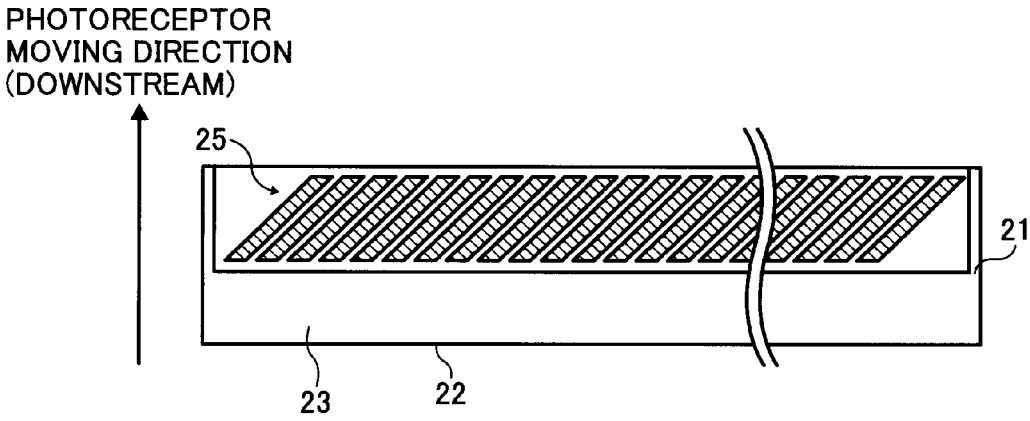
FIG. 2 is a schematic diagram illustrating the corona charger of FIG. 1 as viewed from a photoreceptor serving as a device to be charged.

FIG. 2 is a diagram illustrating the corona charger 2 as viewed from a photoreceptor 1 serving as a device to be charged.

A description will now be given of the corona charger 2 according to the exemplary embodiment.

The corona charger 2 at least includes a case 22 having an opening 23 facing the photoreceptor 1; a corona electrode 21; a grid electrode 25; and a first high-voltage power source 28 for applying AC voltage superimposed on DC voltage to the corona electrode 21.

The grid electrode 25 is provided at the opening 23 of the case 22. However, the grid electrode 25 is not provided at a position upstream of the photoreceptor 1 in a moving direction of the photoreceptor 1 shown by an arrow but at a position downstream of the photoreceptor 1 in the moving direction.

A target charge potential of the photoreceptor 1 is approximately −400 V.

The corona electrode 21 is a wire made of tungsten having a diameter of 60 μm and is stretchedly provided in a shaft direction of the photoreceptor 1 at substantially a center of the case 22.

The first high-voltage power source 28 applies the AC voltage superimposed on the DC voltage to the corona electrode 21. For example, the voltage having a following condition is applied to the corona electrode 21: the DC component is −400V; the AC component is 10 kV at peak-to-peak voltage; and the frequency is 1 kHz.

The case 22 is made of stainless steel plate having a thickness of 1 mm and is U-shaped so as to be open on a lateral side. Although stainless steel is used in this exemplary embodiment, any other suitable material may be used for the case 22 as long as the material is conductive. In this exemplary embodiment, stainless steel is used for ozone resistance.

A width of the opening W of the case 22 in the surface moving direction of the photoreceptor 1 is approximately 15 mm, with the corona electrode 21 provided at substantially a center thereof.

The grid electrode 25 is provided at a position downstream of the opening 23 of the case 22. The distance H between the corona electrode 21 and the grid electrode 25 is configured to be 7 mm.

The width of the grid electrode 25 in the surface moving direction of the photoreceptor 1 is 8 mm, so that substantially half the opening 23 of the case 22 is covered.

The grid electrode 25 is made of stainless steel plate having a thickness of 0.1 mm and having a mesh structure with a mesh pitch of 1 mm by way of edging processing.

Figure 3:
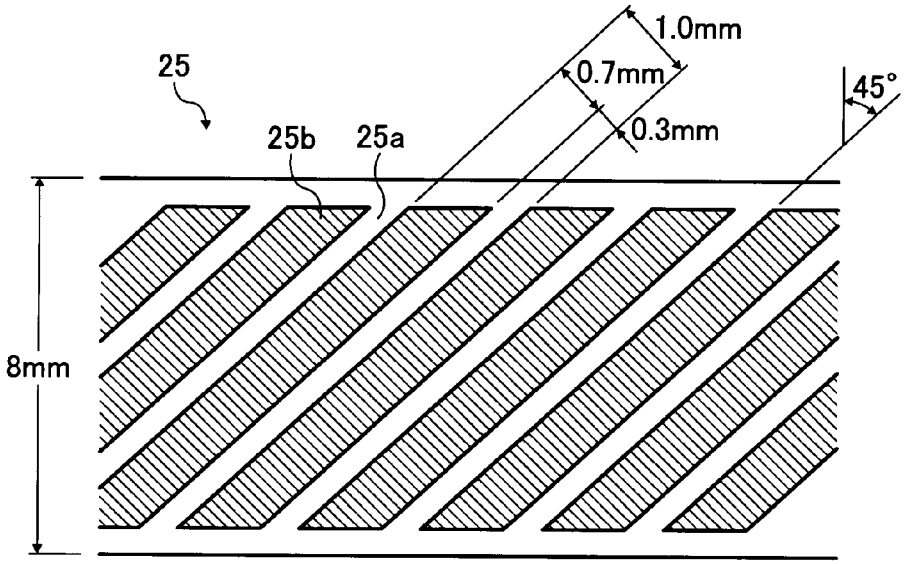
FIG. 3 is a schematic diagram illustrating a mesh portion of a grid electrode of the corona charger according to the first exemplary embodiment.

FIG. 3 is a schematic diagram illustrating a mesh portion of the grid electrode 25.

The grid electrode 25 includes openings 25*b* and mesh portions 25*a* made of stainless steel plate.

The opening 25*b* of the grid electrode 25 has a width of 0.7 mm.

The mesh portion 25*a* of the grid electrode 25 has a width of 0.3 mm. The mesh portion 25*a* is angled 45 degrees in the surface moving direction of the photoreceptor 1 and is subjected to edging processing in the tilted state.

A second high-voltage power source 29 applies a DC voltage of −400 V to the grid electrode 25 of the corona charger 2 so that the grid potential (Vg2) becomes −400 V.

The second high-voltage power source 29 applies the DC voltage of −400 V to the case 22.

No grid electrode 25 is provided to a first charging region 31 of the corona charger 2, at a position upstream of the photoreceptor 1 in the surface moving direction of the photoreceptor 1 as shown in FIG. 1.

In the first charging region 31, positive and negative corona discharges generated by the corona discharge of the corona electrode 21 are supplied directly to the photoreceptor 1 so that the amount of corona discharge to the photoreceptor 1 is increased.

Therefore, in the first charging region 31, a substantial corona discharge is supplied to the photoreceptor 1, making it possible to facilitate high-speed charging.

When passing the first charging region 31, the photoreceptor 1 is charged to a potential near a desired charge potential. However, good charge uniformity may not be achieved.

The grid electrode 25 is provided to a second charging region 32 as shown in FIG. 1. The grid potential (Vg2) of the grid electrode 25 in the second charging region 32 at the position downstream of the photoreceptor 1 in the surface moving direction is −400 V.

In the second charging region 32, the grid electrode 25 regulates the flow of the corona discharge to the photoreceptor 1.

Therefore, in the second charging region 32, the corona discharge regulated by the grid electrode 25 charges the photoreceptor 1 to a potential near the grid potential. Accordingly, it is possible to achieve the charge uniformity.

As seen in the DC-type scorotron charger, the surface of the grid electrode 25 is degraded due to prolonged use, causing the charge potential of the photoreceptor 1 to fluctuate. However, in the corona charger 2, the problem of deterioration in the grid electrode 25 seen in the DC-type scorotron charger is reduced if not prevented. Accordingly, stable charge uniformity over time is achieved.

Thus, as described above, it is possible to achieve high-charging ability in the first charging region 31 and the charge uniformity in the second charging region 32. In addition, the width of the opening of the corona charger 2 is similar to, if not the same as, the width of the opening of a normal scorotron charger, that is, approximately 15 mm. The width of the opening of the corona charger 2 is substantially smaller than that of the DC/AC-double charger.

Therefore, charge uniformity and high-charging ability are enhanced without increasing the size of the charger.

Second Exemplary Embodiment

Next, a description will be given of the corona charger 2 according to a second exemplary embodiment.

Figure 4:
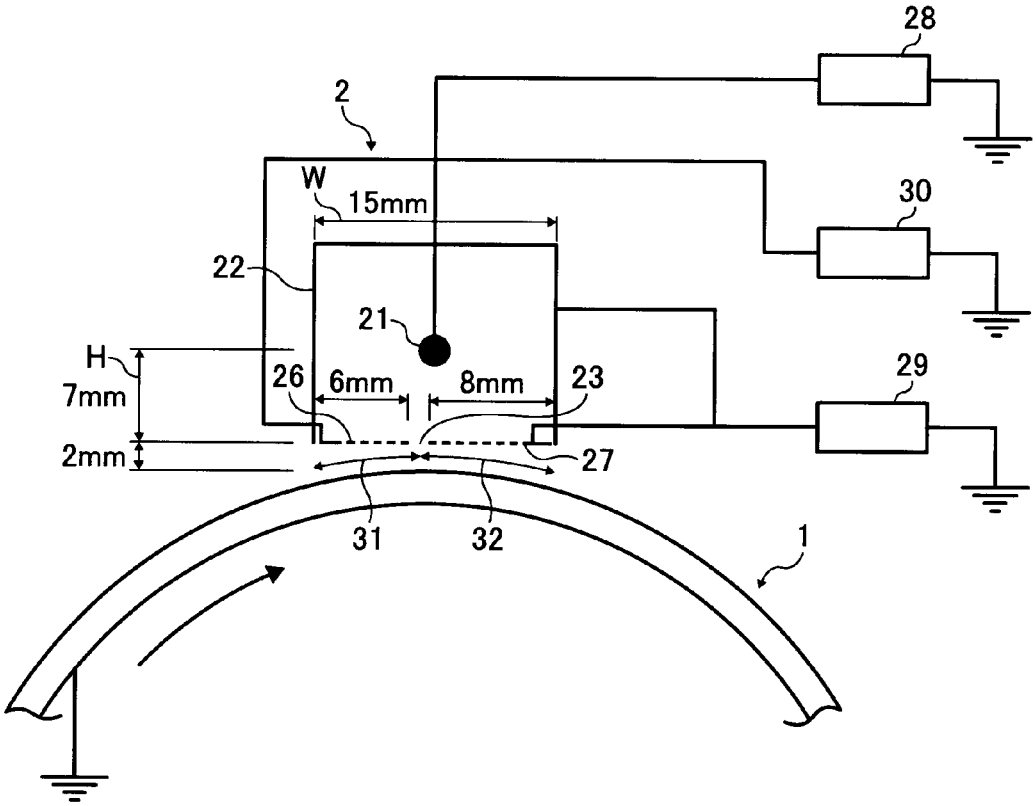
FIG. 4 is a cross-sectional view illustrating the corona charger according to a second exemplary embodiment.

FIG. 4 is a cross-sectional view illustrating the corona charger 2 according to the second exemplary embodiment.

Figure 5:
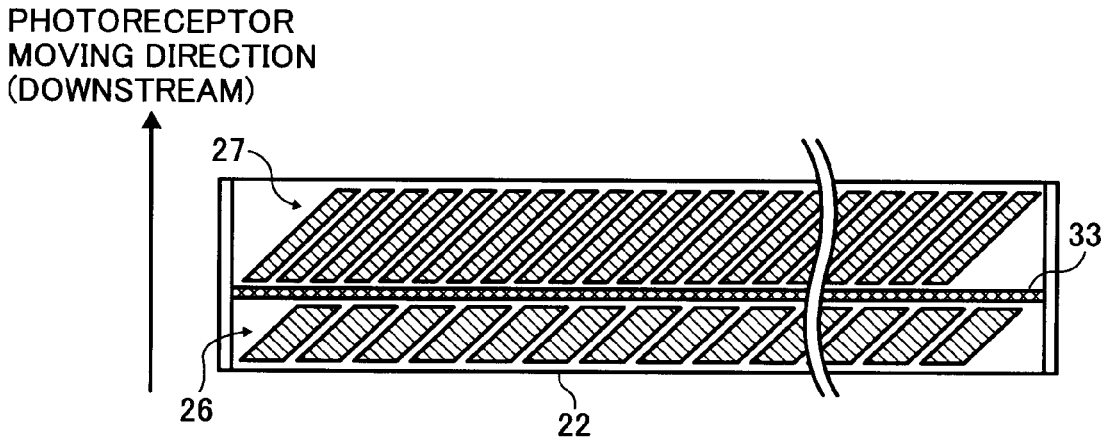
FIG. 5 is a schematic diagram illustrating the corona charger of FIG. 4 as viewed from the photoreceptor.

FIG. 5 is a schematic diagram illustrating the corona charger 2 as viewed from the photoreceptor side.

The corona electrode 21, the case 22, the first high-voltage power source 28 and so forth of the corona charger 2 according to the second exemplary embodiment are similar to, if not the same as, those of the corona charger 2 of the first exemplary embodiment.

As shown in FIG. 5, in the corona charger 2, a first grid electrode 26 and a second grid electrode 27 are separately provided upstream and downstream of the case 22, respectively, and electrically insulated from each other by an insulator 33.

The first grid electrode 26 provided upstream in the photoreceptor moving direction is made of stainless steel plate having a thickness of 0.1 mm, which is the same material as the material used for the grid electrode 25. The first grid electrode 26 has a mesh structure with a mesh pitch of 2 mm by way of edging processing.

Figure 6:
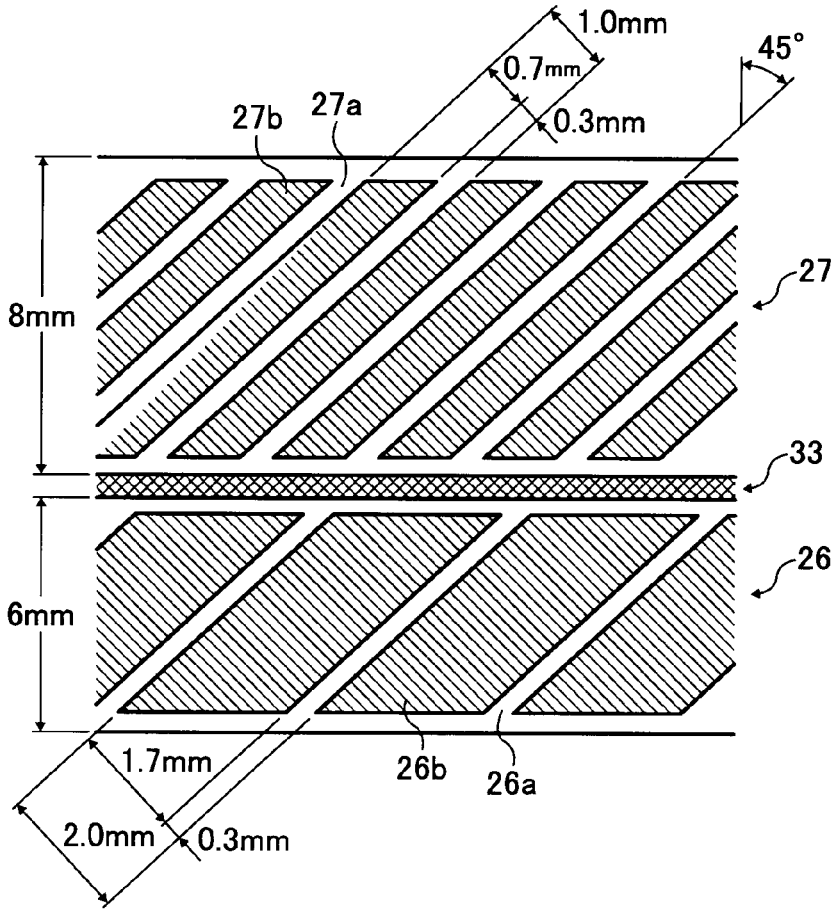
FIG. 6 is a schematic diagram illustrating a mesh portion of grid electrodes of the corona charger according to the second exemplary embodiment.

Referring now to FIG. 6, there is provided an explanatory diagram illustrating the mesh portion of the first grid electrode 26 and the second grid electrode 27.

The first grid electrode 26 includes mesh openings 26*b* and mesh portions 26*a* made of stainless steel plate. The mesh openings 26*b* of the first grid electrode 26 each have a width of 1.7 mm. The mesh portions 26*a* of the first grid electrode 26 each have a width of 0.3 mm.

The mesh portion 26*a* is angled 45 degrees relative to the surface moving direction of the photoreceptor 1 and is subjected to edging processing in the tilted state.

The width of the first grid electrode 26 in the surface moving direction of the photoreceptor 1 is 6 mm.

A third high-voltage power source 30 applies a DC voltage of −550 V to the first grid electrode 26 so that the first grid potential (Vg1) becomes −550 V.

The second grid electrode 27 provided downstream in the surface moving direction of the photoreceptor 1 is similar to, if not the same as, the grid electrode 25 of the first exemplary embodiment.

The second grid electrode 27 is made of stainless steel plate having a thickness of 0.1 mm and a mesh structure with a mesh pitch of 1 mm by way of edging processing.

As shown in FIG. 6, the second grid electrode 27 includes openings 27*b* and mesh portions 27*a*. The opening 27*b* of the second grid electrode 27 has a width of 0.7 mm. The mesh portion 27*a* of the second grid electrode 27 has a width of 0.3 mm.

The mesh portion 27*a* is angled 45 degrees relative to the surface moving direction of the photoreceptor 1 and is subjected to edging processing in the tilted state.

Similar to the case 22, the second high-voltage power source 29 applies a DC voltage of −400 V to the second grid electrode 27 so that the grid potential (Vg2) becomes −400 V.

In the corona charger 2, in the first charging region 31 including the first grid electrode 26 having the first grid potential (Vg1) of −550 V, the first grid electrode 26 regulates the corona discharge to the photoreceptor 1.

The first grid electrode 26 has a relatively large first grid potential (Vg1), for example, −550 V, so that a relatively large amount of positive and negative corona discharges generated during the corona discharge by the corona electrode 21 is supplied to the photoreceptor 1.

Accordingly, a substantial corona discharge is supplied to the photoreceptor 1 in the first charging region 31, thereby facilitating high-speed charging.

The second grid electrode 27 having the second grid potential (Vg2) of −400 V is provided to the second charging region 32 at the position downstream of the photoreceptor 1. Similar to the first exemplary embodiment, the corona discharge regulated by the second grid electrode 27 charges the photoreceptor 1 to a level close to the second grid potential (Vg2) of −400 V.

Accordingly, it is possible to attain charge uniformity.

Thus, as described above, it is possible to attain high-speed charging ability in the first charging region 31 and charge uniformity in the second charging region 32.

Similar to the corona charger 2 of the first exemplary embodiment, the width of the opening of the corona charger 2 according to the second exemplary embodiment is approximately 15 mm, which is the same width of the opening as a normal scorotron charger. The width of the opening is smaller than the width of the opening of the DC/AC double charger.

Accordingly, it is possible to enhance charge uniformity and high-speed charging ability without increasing the size of the charger.

Figure 20:
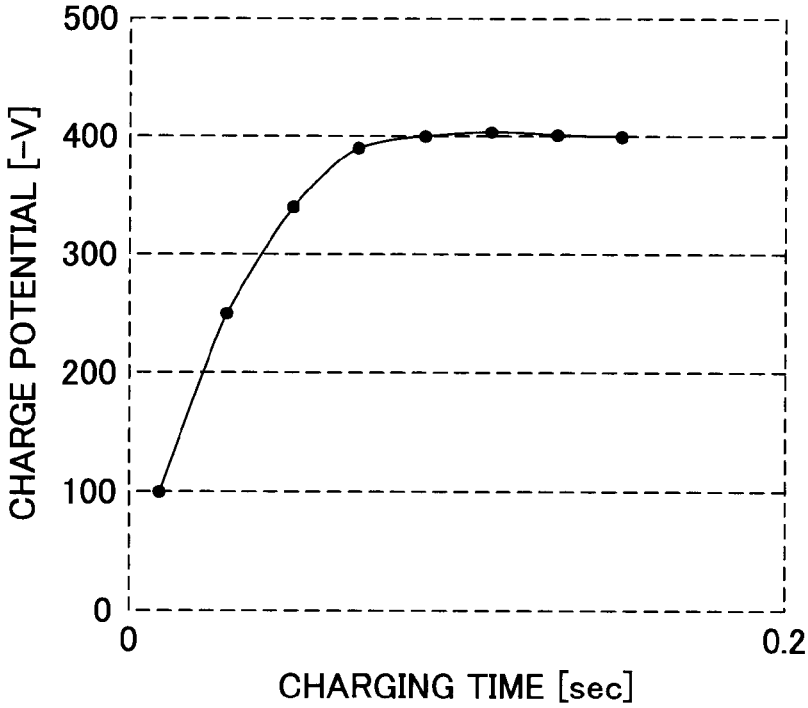
FIG. 20 is a graphical representation of a relation between a charge potential and a charging time of a scorotron charger according to the exemplary embodiments.

Referring now to FIG. 20, there is provided a graphical representation of a relation between the charge potential and the charging time of the scorotron charger.

In FIG. 20, the horizontal axis represents the charging time and the vertical axis represents the charge potential of the photoreceptor. FIG. 20 shows how the moving surface of the photoreceptor is charged.

As seen in FIG. 20, the charge potential of the photoreceptor 1 increases in a manner represented by a saturation curve, in which the charge potential of the photoreceptor approaches the saturation level of the grid potential as time elapses.

In order to charge the photoreceptor 1 to the same potential in a short period of time, it is advantageous to set the grid potential as large as possible.

However, when the grid potential is set large, charge uniformity is not achieved. Thus, the grid potential is rarely set so large.

When the photoreceptor 1 is not saturated to the grid potential, the charge potential varies between areas where the amount of corona discharge is relatively large and areas where the amount of corona discharge is smaller. Consequently, the charge uniformity is degraded.

A normal scorotron charger is used, such that the target charge potential of the photoreceptor 1 and the grid potential are as close as possible.

However, according to the second exemplary embodiment, when the potential of the first grid electrode 26 at the first charging region 31 upstream of the photoreceptor 1 and the potential of the second grid electrode 27 at the second charging region 32 downstream of the photoreceptor 1 are different, highly accurate charge uniformity is not required.

The charge uniformity may be achieved at the second grid electrode 27 at the downstream while the photoreceptor 1 is charged to the similar value as the target charge potential at the upstream.

As described above, the following relation is satisfied:

$$|Vg1|>|Vg2|,$$

where |Vg1| is an absolute value of the first grid potential of the first grid electrode 26 at the upstream side and |Vg2| is an absolute value of the second grid potential 27 at the downstream side.

According to the exemplary embodiment, the absolute value |Vg1| of the first grid potential is 550 V. The saturation point is substantially high relative to the target charge potential, for example, −400 V. Accordingly, a substantially large amount of negative ions is forced to be generated.

The absolute value |Vg2| of the second grid potential is 400 V. Thus, the charge potential is regulated to have a similar value as the second grid potential.

In order to enhance high-speed charging ability, it is desirable to configure a density of the opening of the grid electrode to be relatively high, so that a small corona discharge flows to the grid electrode while the corona discharge supplied to the photoreceptor 1 increases.

However, when the density of the opening is too high, the charge uniformity of the photoreceptor 1 is degraded.

According to the second exemplary embodiment, the density ρ1 of the opening of the first grid electrode 26 at the upstream side is configured to be greater than the density ρ2 of the opening of the second grid electrode 27 at the downstream side.

As a result, it is not necessary to achieve highly accurate charge uniformity at the first grid electrode 26. The photoreceptor 1 is charged to a substantially similar if not identical value as the target value, and charge uniformity can be achieved at the second grid electrode 27 on the downstream side.

Comparative experiments performed to compare high-speed performance and the charge uniformity using the corona charger of the first and the second exemplary embodiments are described below.

First Comparative Experiment

A description will now be given of a first comparative experiment.

The first comparative experiment was performed to compare high-speed performance of the corona charger 2 of the first and the second exemplary embodiments with that of a corona charger of a first comparative example.

The corona charger of the first comparative example to be compared with the corona charger 2 of the first and the second exemplary embodiments is a so-called normal AC-type scorotron charger, disposed such that the grid electrode covers the substantially entire opening 23 of the case 22.

The corona charger 2 of the first and the second exemplary embodiments, and the corona charger of the first comparative example, were disposed such that the distance between the grid electrode and the photoreceptor was 2 mm.

The corona charger 2 of the first and the second exemplary embodiments, and the corona charger of the first comparative example, charged the surface of the photoreceptor 1 while the photoreceptor 1 rotated.

A surface electrometer (Model 344 manufactured by Trek Co., Ltd.) was disposed 30 mm downstream from the corona charger 2 in the moving direction of the photoreceptor 1 to measure the charge potential of the photoreceptor 1.

During the measurement of the charge potential of the photoreceptor 1, the moving speed of the photoreceptor 1 was varied from 50 mm/sec to 350 mm/sec to evaluate high-speed performance.

Figure 7:
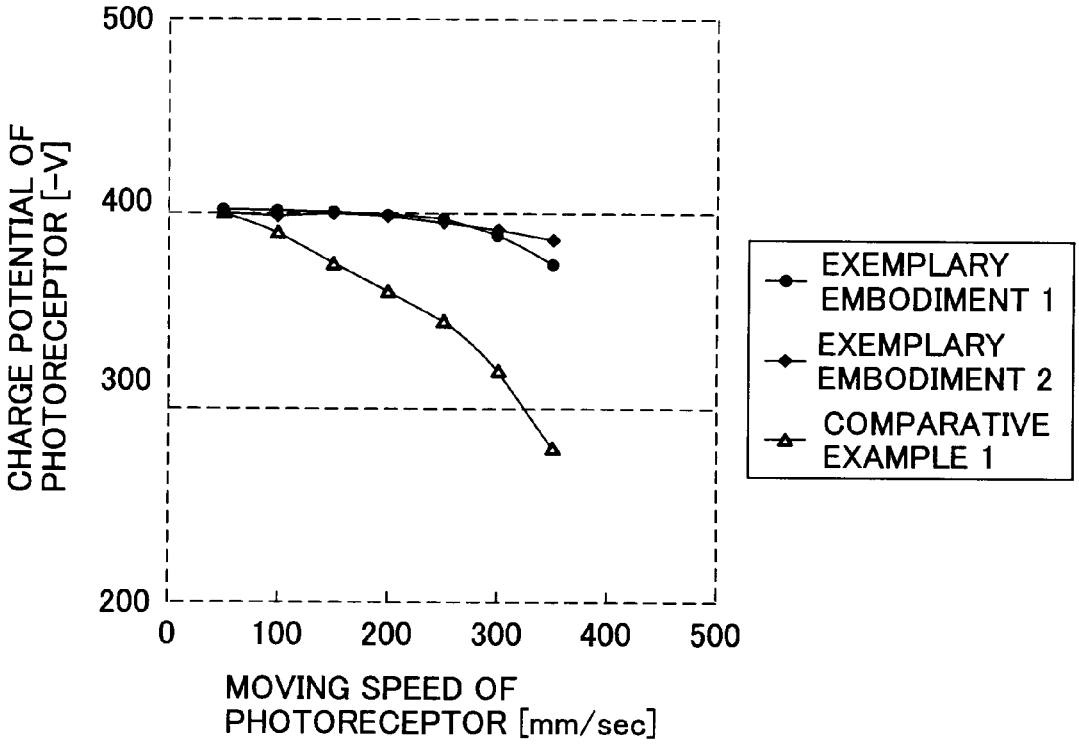
FIG. 7 is a graphical representation of a relation between a moving speed and a charge potential of the photoreceptor when using the corona charger of the first and the second exemplary embodiments, and a first comparative example.

FIG. 7 is a graphical representation of the results of the first comparative experiment. In FIG. 7, the horizontal axis is the moving speed of the photoreceptor 1 and the vertical axis is the charge potential of the photoreceptor.

As shown in FIG. 7, as the moving speed of the photoreceptor 1 increased, the charge potential of the first comparative example dropped. On the other hand, the decrease in the charge potential of the first and the second exemplary embodiments was less than that of the first comparative example, thus indicating that the corona charger of the first and the second exemplary embodiments provides better high-speed performance than does the first comparative example.

Second Comparative Example

A description will now be given of a second comparative experiment.

The second comparative experiment was performed to determine the degree of charge uniformity in the longitudinal direction of the charger using the corona charger 2 of the first exemplary embodiment.

In the first exemplary embodiment, the width of the grid electrode 25 in the surface moving direction of the photoreceptor is 8 mm. In the second comparative experiment, the grid width of the grid electrode was varied from 2 mm to 15 mm.

Using the grid electrode having different grid widths, similar to the first comparative experiment, the charge potential was measured while rotating the photoreceptor 1. The moving speed of the photoreceptor 1 was 150 mm/sec.

In order to detect the degree of uniformity of the charge potential of the photoreceptor in the longitudinal direction, the surface electrometer was movably disposed in the longitudinal direction. The charge potential was measured while moving the surface electrometer.

Discharge over an extended period of time causes the charge potential in the longitudinal direction to vary over time. This problem may not be significant in an initial state, however, and therefore, in the second comparative experiment, the charge uniformity was evaluated after the discharge was continuously performed for 100 hours in order to ensure accurate detection.

Figure 8:
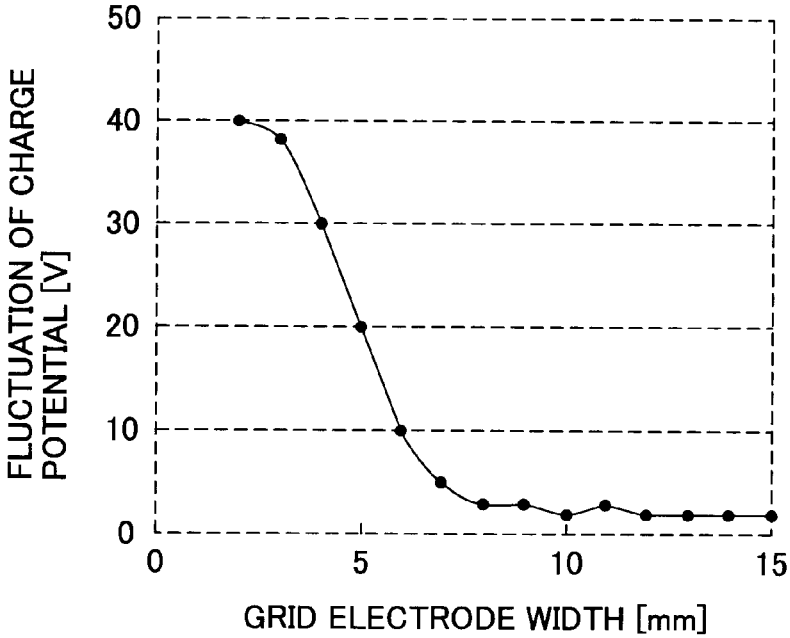
FIG. 8 is a graphical representation of a relation between a grid width and charge uniformity when using the corona charger of the first exemplary embodiment.

With reference to FIG. 8, the result of the second comparative experiment is illustrated.

In FIG. 8, the horizontal axis represents the width of the grid electrode. The vertical axis represents fluctuation in the charge potential of the photoreceptor in the longitudinal direction. The fluctuation herein refers to a difference between a maximum value and a minimum value of the charge potential.

As shown in FIG. 8, when the grid width increased, the fluctuation of the charge potential in the longitudinal direction decreased. Specifically, when the grid width was 7 mm or greater, the charge uniformity increased. In other words, the fluctuation of the charge potential in the longitudinal direction was 5 V or less.

In an ordinary image forming apparatus, when the fluctuation of the charge potential in the longitudinal direction is 5 V or less, it is likely that the output image is not affected, and therefore it is possible to output a high-quality image.

In the corona charger 2 of the first exemplary embodiment, the width of the grid electrode 27 is 8 mm. Therefore, a substantial charge uniformity can be achieved.

When the ratio of W2/W is greater than or equal to 0.5 and less than 1.0, where W represents the entire width of the opening of the corona charger 2 (W=W1+W2), W1 is the width of the opening of the first charging region 31, and W2 is the width of the opening of the second charging region 32 where the grid electrode 25 is provided, charge fluctuation is substantially slight, for example, not greater than 5 V.

Furthermore, in order to accommodate both high-speed ability and charge uniformity in a balanced manner, it is preferable that the ratio of W2/W be no less than 0.5 and no greater than 0.8, that is, that the relation between W1 and W2, where W1 is the width of the opening of the first charging region 31 and W2 is the width of the opening of the second charging region 32, be W1<W2.

Third Comparative Experiment

A description will now be given of a third comparative experiment.

The third comparative experiment was performed to determine the degree of charge uniformity in the longitudinal direction of the charger using the corona charger 2 of the second exemplary embodiment.

In the second exemplary embodiment, the width of the first grid electrode 26 in the surface moving direction of the photoreceptor 1 is 6 mm, and the width of the second grid electrode 27 is 8 mm.

In the third comparative experiment, the grid width of the second grid electrode 27 was varied from 2 mm to 15 mm. According to the width of the second grid electrode 27, the width of the first grid electrode 26 varied from 12 mm to 2 mm.

Similar to the second comparative experiment, the third comparative experiment was performed to evaluate the degree of charge uniformity using the grid electrodes while varying the first grid width and the second grid width. The results of the third comparative experiment are shown in FIG. 9.

Figure 9:
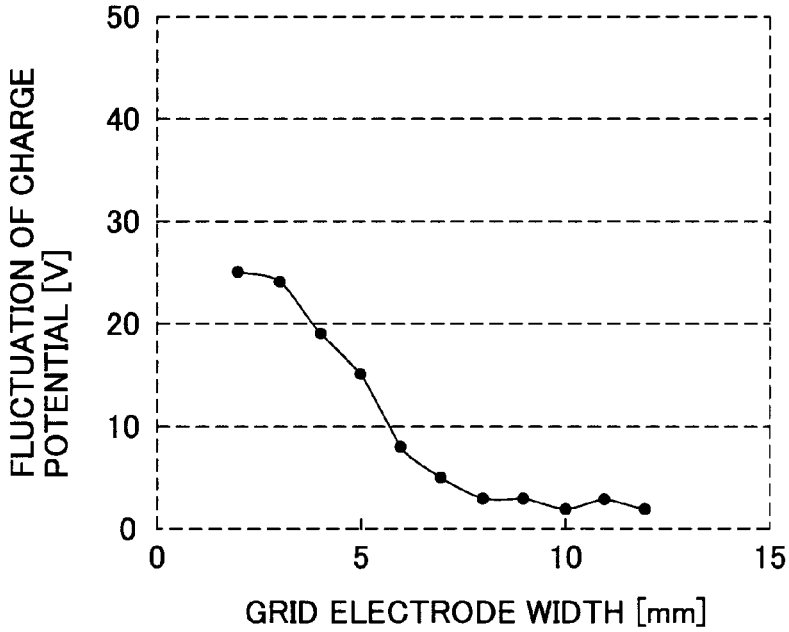
FIG. 9 is a graphical representation of a relation between a grid width and charge uniformity when using the corona charger of the second exemplary embodiment.

In FIG. 9, the horizontal axis represents the width of the second grid electrode 27. The vertical axis represents fluctuation of the charge potential of the photoreceptor in the longitudinal direction. The fluctuation herein refers to a difference between the maximum value and the minimum value of the charge potential.

As shown in FIG. 9, when the second grid width increased, the fluctuation of the charge potential of the photoreceptor in the longitudinal direction decreased. When the grid width was 7 mm or greater, the charge uniformity increased. In other words, the charge fluctuation was 5 V or less.

As described above, when the charge uniformity is 5 V or less, it is possible to output a high-quality image.

In the corona charger 2 of the second exemplary embodiment, the width of the second grid electrode 27 is 8 mm. Therefore, substantial charge uniformity can be achieved.

When the ratio of W2/W is greater than or equal to 0.5 and less than 1.0, the charge fluctuation is not greater than 5 V.

Furthermore, in order to accommodate both high-speed ability and charge uniformity in a balanced manner, it is preferable that the ratio of W2/W be no less than 0.5 and no greater than 0.8, that is, W1<W2.

Next, a description will be given of a full-color image forming apparatus using the above-described corona charger 2.

Figure 10:
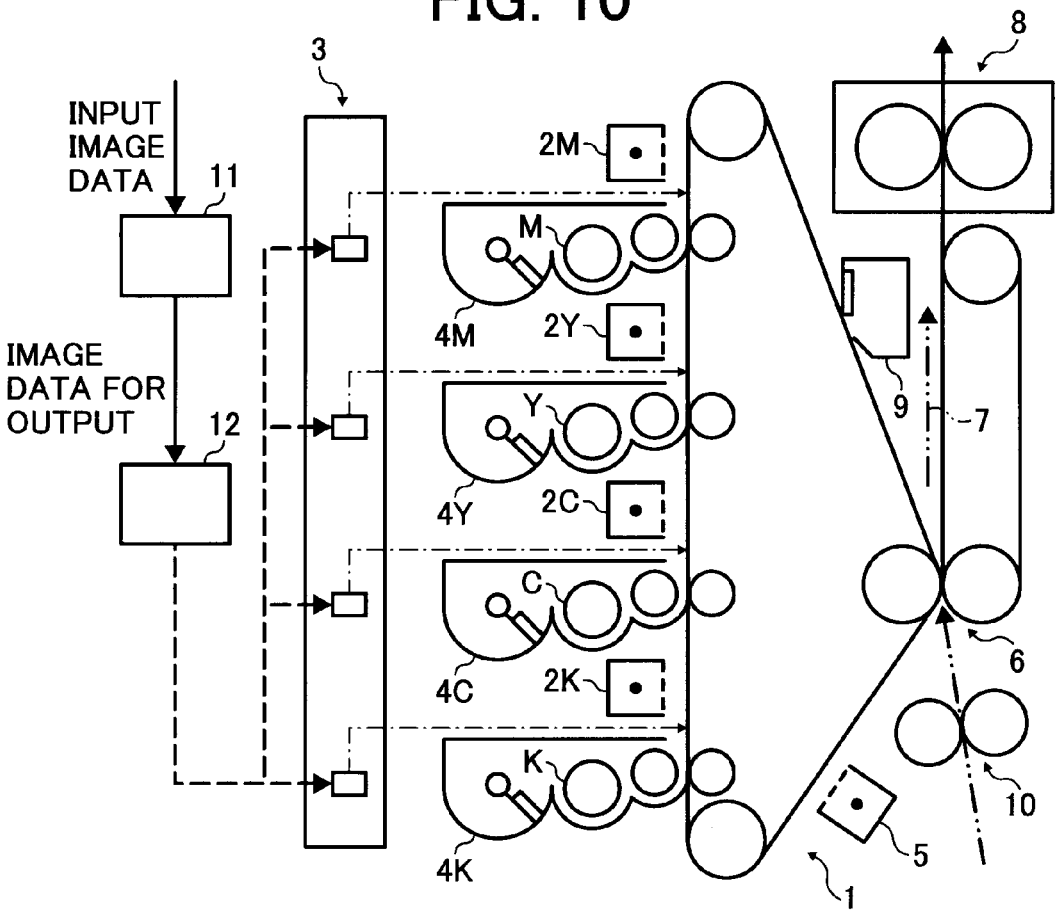
FIG. 10 is a schematic diagram illustrating the full-color image forming apparatus according to the exemplary embodiments.

Referring now to FIG. 10, there is provided a schematic diagram illustrating the full-color image forming apparatus according to the exemplary embodiments.

The full-color image forming apparatus produces a color image by overlaying toner images of four different colors including magenta (M), yellow (Y), cyan (C) and black (K) on the photoreceptor 1. The letter symbols M, Y, C and K herein refer to magenta, yellow, cyan and black, respectively.

In the full-color image forming apparatus, a belt-type photoreceptor 1 is disposed substantially at the center.

In the full color image forming apparatus, four chargers 2M, 2Y, 2C, and 2K, and four developing units 4M, 4Y, 4C and 4K for four colors magenta, yellow, cyan and black are arranged from upstream to downstream along a rotation direction of the photoreceptor 1 shown by an arrow in FIG. 10.

The image forming apparatus further includes a writing unit 3, a pre-transfer charger 5, a transfer unit 6, and a fixing unit 8.

The charger 2M evenly charges the photoreceptor 1. The writing unit 3 optically scans the photoreceptor 1 so as to form an electrostatic latent image of magenta on the photoreceptor 1. The developing unit 4M develops the electrostatic latent image to form a toner image of magenta on the photoreceptor 1.

Similar to the magenta color, toner images of other colors yellow, cyan and black are overlaid on one another on the photoreceptor 1.

After the pre-transfer charger 5 adjusts the charge of the overlaid toner images, the transfer unit 6 transfers the overlaid toner images from the photoreceptor 1 onto a recording sheet 7 which is a transfer material. The toner images of four colors M, C, Y and K are transferred all at once.

Subsequently, the toner image transferred onto the recording sheet 7 is thermally fixed by the fixing unit 8 to form an image on the recording sheet 7.

The photoreceptor 1 is a multilayer-type photoreceptor that includes a belt-type conductive base on which an under layer (UL), a charge generating layer, and a charge transfer layer are laminated.

The photoreceptor 1 rotates in a direction shown by an arrow at a peripheral velocity of 100 mm/sec.

The chargers 2M, 2Y, 2C and 2K may employ, for example, the corona charger 2 of the first exemplary embodiment to charge the photoreceptor 1. In this case, immediately after passing the first charging region 31 the surface potential Vp1 of the photoreceptor 1 is charged to −500 V.

Immediately after passing the second charging region 32, the surface potential Vp2 is evenly charged to −400 V.

In other words, the chargers 2Y, 2C, and 2K temporarily charge the surface of the photoreceptor 1 on which the toner image is formed to a substantially large potential. Subsequently, the chargers 2Y, 2C, and 2K reduce the charge potential of the photoreceptor 1 so as to adjust the charge potential to the target charge potential.

Preferably, the relation between |Vp1| and |Vg2|, where the absolute value |Vp1| is the surface potential of the photoreceptor 1 immediately after passing the first charging region 31 and the absolute value |Vg2| is the second grid potential in the second charging region 32, is such that |Vp1|/|Vg2| is no less than 1.0 and no more than 2.0.

When |Vp1|/|Vg2| is 2.0 or greater, it becomes difficult to reduce the surface potential of the photoreceptor 1 to the desired potential at the second charging region 32 at the downstream portion.

Furthermore, it is preferable that |Vp1|/|Vg2| be no less than 1.2 and no more than 1.8.

In the writing unit 3, an optical element is disposed such that a laser beam optically modulated through a laser diode (LD) element scans the surface of the photoreceptor 1 so that an electrostatic latent image corresponding to a desired image is formed on the photoreceptor 1.

In the writing unit 3, an LD element having a wavelength of 780 nm is used. The pre-transfer charger 5 is a scorotron charger that charges the toner images overlaid on the photoreceptor 1 to −400 V.

The transfer unit 6 includes a transfer roller having conductivity and elasticity. The transfer unit 6 is disposed such that the transfer roller presses the photoreceptor 1 from the rear surface of the recording sheet 7 when the image is transferred to the recording sheet 7.

A constant-current regulated bias (40 μmA) is applied as a transfer bias to the transfer roller.

The recording sheet 7 is transported by a transport mechanism from a sheet bank, not shown. Subsequently, a registration roller 10 sends the recording sheet 7 to the transfer unit 6 at a predetermined timing. The recording sheet 7 is transported to the transfer unit 6.

In the transfer unit 6, as described above, the toner images of four colors on the photoreceptor 1 are transferred to a desired position on the recording sheet 7.

In the fixing unit 8, the recording sheet 7 on which the toner images are transferred is heated and pressed so that the toner images are fixed on the recording sheet 7. Subsequently, the recording sheet 7 is discharged from the image forming apparatus.

Next, a description will be given of an image processing unit of the full-color image forming apparatus, which obtains output image data from input image data.

Figure 11:
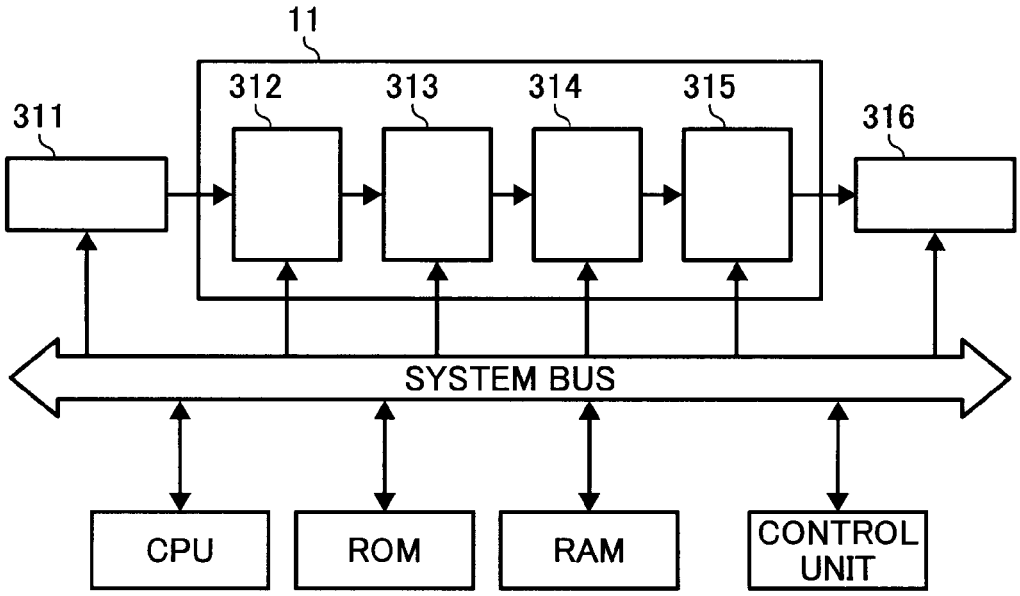
FIG. 11 is a schematic diagram illustrating an image processing unit of the full-color image forming apparatus of FIG. 10 according to the exemplary embodiments.

Referring now to FIG. 11, there is provided a block diagram illustrating an image processing unit 11 employed in the full-color image forming apparatus.

In FIG. 11, a digital image signal serving as input image data consists of an 8-bit color image signal for RGB.

In the image processing unit 11, the input image data from an image input unit 311, for example, a personal computer (PC), is subjected to filtering in an MTF filtering unit 312 and is converted to CMYK data in a color separation unit 313.

Subsequently, in a gradation conversion unit 314, the CMYK data is subjected to γ-conversion so as to reflect input/output characteristics.

In a pseudo halftone processing unit 315, the CMYK data is subjected to pseudo halftone processing so as to obtain image data for output. The output image data consists of a 4-bit color image signal for the colors CMYK.

The image processing method described above is but one example of an image processing method, and does not limit the scope of the invention. Thus, the present invention may employ an image processing method other than the method described above. In addition, the image processing method may be of a related art image processing method.

Next, a description will be given of an operation of the writing unit 3 or a laser optical unit, which operates according to the output image data produced in the above-described manner.

An image signal processing unit 316 receives the output image data created in the image processing unit 11 and stores data of the number of luminous points (laser diodes (LD)) in a line memory.

In accordance with a signal or a so-called synchronization signal in synchronization with the rotation of the polygon mirror, the data in the line memory corresponding to each pixel is transmitted to a pulse-width modulation (PWM) control unit at a predetermined timing or a pixel clock.

In the writing unit 3, each color has at least one luminous point, that is, a laser diode.

In the PWM control unit, the data is converted to a pulse-width modulation (PWM) signal and is transmitted to an LD driver.

The LD driver performs optical modulation driving of the LD element or an LD array at a predetermined amount of light according to the pulse-width modulation (PWM) signal. The LD driver performs pulse-width modulation (PWM) control according to the output image data for each color component. Accordingly, optical modulation driving of the laser beam is performed.

The light emitted from the LD forms a parallel light at the collimating lens, and a light flux corresponding to a desired beam diameter is formed through an aperture.

After passing through the aperture, the light flux passes through the cylindrical lens and enters the polygon mirror. The light flux reflected by the polygon mirror is focused by a scan lens or an f-θ lens and is reflected by a reflective mirror.

Subsequently, the reflected light flux is imaged on the photoreceptor surface.

In the writing unit 3, the LD performs optical writing at a resolution of 600 dpi. Furthermore, the PWM is structured to have a 6-bit of freedom.

In the above-described image processing unit 11, after quantization of the output image data in the pseudo-halftone processing, the output image data is converted to 600 dpi 4-bit data. Thus, the light emission of LD is controlled by associating the 4-bit in 6-bit with the output image data, which is the data after the pseudo-halftone processing.

Therefore, there are 16 ways of LD emission, including a state in which the LD does not emit. The LD emission is performed for the 4-bit corresponding to the output image data.

The laser beam optically modulated in the above-described manner is focused on and scans the photoreceptor 1. Accordingly, an electrostatic latent image corresponding to a desired image is formed on the photoreceptor 1.

Next, a description will be given of the developing units 4M, 4Y, 4C and 4K. Except for the designated colors, the developing units 4M, 4Y, 4C and 4K have a similar if not identical, structure, and operate in a similar or the same manner. Thus, the letter symbols representing colors M, Y, C and K are omitted herein.

Figure 12:
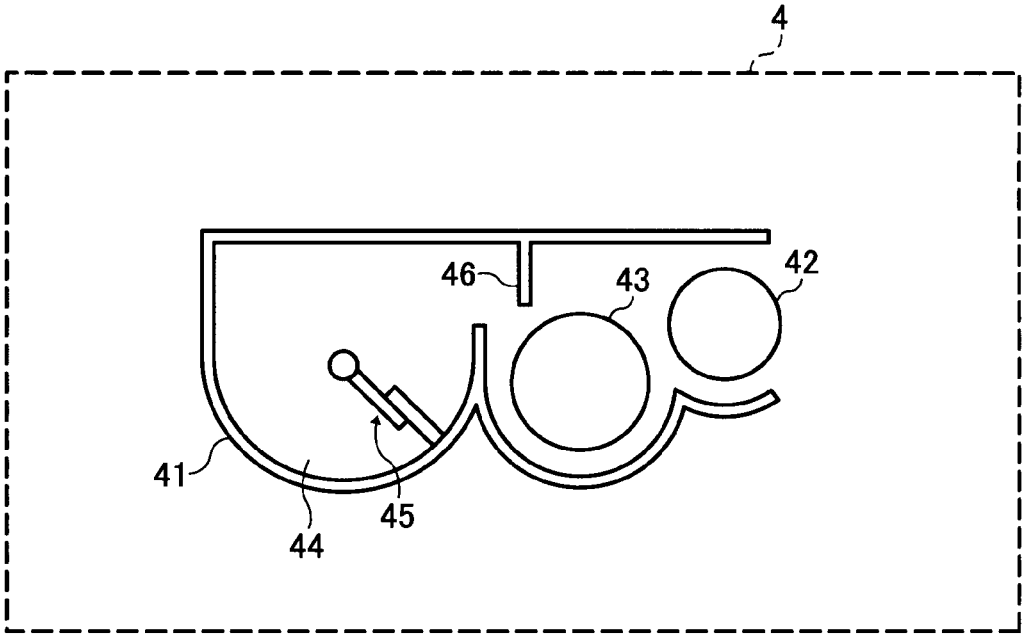
FIG. 12 is a schematic diagram illustrating a developing unit of the full-color image forming apparatus of FIG. 10 according to the exemplary embodiments.

Referring now to FIG. 12, there is provided a schematic diagram illustrating the developing unit 4.

The developing unit 4 at least includes: a casing 41; a toner carrier 42 for transporting toner to the developing region; a toner supply roller 43 for supplying toner to the toner carrier 42; a toner storage 44 for storing toner; a toner supply unit 45 for supplying toner to the toner supply roller 43; and a toner regulating member 46 for regulating an amount of toner adhered to the toner supply roller 43.

The toner carrier 42 has a cylindrical shape having a diameter of 10 mm, and is disposed in a non-contact manner relative to the photoreceptor 1 in a stationary state. For example, the toner carrier 42 is disposed facing the photoreceptor 1, with a gap of 0.20 mm therebetween.

The toner carrier 42 transports toner by way of a transport electrical field which is a progressing wave electrical field formed on the surface thereof. The toner carrier 42 transports toner supplied from the toner supply roller 43 to the developing region. The electrostatic latent image formed on the opposing photoreceptor 1 is developed with the toner to form a toner image.

The toner supply roller 43 has a cylindrical shape having a diameter of 12 mm, and is rotated at a rotation speed of, for example, 326 rpm by a drive mechanism, not shown.

The toner supply roller 43 is disposed at a position substantially opposite the toner carrier 42 in the developing region in a non-contact manner. For example, the toner supply roller is disposed facing the toner carrier 42, with a gap of 0.20 mm therebetween.

A potential difference of 1.3 kV is provided between the toner supply roller 43 and the toner carrier 42. This potential difference causes the toner supply roller 43 to supply toner to the toner carrier 42.

The toner regulating member 46 regulates the amount of toner such that a certain amount of toner adheres to the surface of the toner supply roller 43. In addition, the toner regulating member 46 is configured such that, when toner comes into contact with the toner supply roller 43 and the toner regulating member 46, the toner has a given charging amount.

When the toner on the toner supply roller 43 is consumed so that the remaining amount of toner decreases, the toner supply unit 45 drives the supply device to supply the toner stored in the toner storage 44 to the toner supply roller 43.

Next, a description will be given of toner used in the developing unit 4. The toner used in the developing unit 4 is a so-called polymerized toner produced by polymerization.

A volume average particle diameter of the toner is configured to be 5.5 μm. The Coulter counter TA-2 manufactured by Coulter Co., which measures particle size, is used to measure the volume average particle diameter of the toner using the aperture diameter of 100 μm.

A similar if not identical manufacturing method is used to produce toners of four colors yellow (Y), cyan (C), magenta (M), and black (K).

In addition to the toner produced by the polymerizing method, toner produced by other methods such as a dispersion-polymerizing method and a pulverizing method may be used.

In the developing unit 4, the toner is adhered to the surface of the toner carrier 42 and is transported to the developing region so as to develop the electrostatic latent image formed on the photoreceptor 1. The amount of toner adhered to the toner carrier surface is 0.7 mg/cm$^2$, for example.

Figure 13:
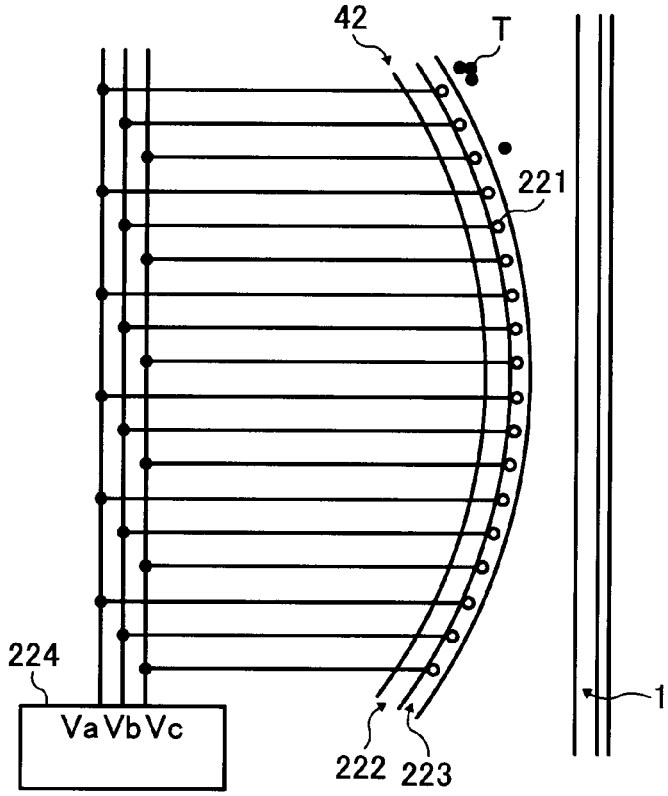
FIG. 13 is a schematic diagram illustrating a toner carrier employed in the developing unit of FIG. 12 according to the exemplary embodiments.

Next, a description will be given of the toner carrier 42. Referring now to FIG. 13, there is provided a schematic diagram illustrating the toner carrier 42.

The toner carrier 42 includes at least a plurality of electrodes 221, a supporting substrate 222, a surface protective layer 223, and a driving circuit 224.

The plurality of electrodes 221 are provided on the surface of the toner carrier 42 to generate an electrical field for carrying, hopping (developing), and collecting the toner T in a form of powder.

The driving circuit 224 applies different driving waveforms Va through Vc of n phases, for example 3 phases, to each electrode 221 in order to generate an appropriate electrical field.

The transport electrical field, which is a progressing wave electrical field formed between the electrodes 221 to which the driving waveforms Va through Vc are applied, transports the toner T to a place near the photoreceptor 1.

The toner T is adhered to the latent image on the photoreceptor 1 so that a toner image is formed. The toner T that is not used during development is collected at the side of the toner carrier 42.

Each electrode 221 of the toner carrier 42 forms an electrical field that causes the toner T to move to an image portion of the latent image on the photoreceptor 1 in the developing region while also causing the toner T to move to a place opposite the photoreceptor 1, that is, to the toner carrier side in the non-image portion of the sheet.

Accordingly, development is performed by adhering the toner T to the latent image. In the developing region, the toner T is adhered to the latent image on the photoreceptor 1 so that the latent image becomes a visible image.

Any toner T not contributing to development is collected at a position downstream in the rotation direction (moving direction) of the photoreceptor 1.

For a supporting substrate 222 of the toner carrier 42 shown in FIG. 13, any substrate made of insulating material such as glass, resin, ceramic or the like may be employed.

In addition, for the supporting substrate 222, a substrate formed of a conductive material such as SUS coated with an insulating film such as SiO2 may be employed. A substrate made of a flexible material such as a polyimide film may also be employed.

In the exemplary embodiments, the polyimide film having a thickness of 0.1 mm is used.

The supporting substrate 222 of the electrodes 221 is coated with a film made of conductive material such as Al and Ni—Cr with a thickness of 0.1 to 10 μm, preferably 0.5 to 2.0 μm, and is formed into a predetermined electrode pattern by a photolithographic technique.

The width L of the plurality of the electrode 221 in the toner traveling direction is configured to be no less than the average particle diameter of the toner to be transported and no greater than 20 times the average particle diameter of the toner to be transported.

The gap R between the electrodes 221 in the toner traveling direction is configured to be no less than the average particle diameter of the toner to be transported and no greater than 20 times the average particle diameter of the toner.

In the exemplary embodiments, for the electrodes 221, Al is employed as an electrode material with a film thickness of 2 μm. The width L, that is, a pitch of the electrodes 221 is 50 μm.

For the surface protective layer 223, a material such as SiO2, TiO2, TiO4, SiON, BN, TiN, Ta2O5 having a thickness of 0.5 to 10 μm, preferably 0.5 to 3 μm, is employed. In addition, an inorganic nitride compound such as SiN, Bn and W may be employed.

In the exemplary embodiments, SiO2 having a film thickness of 3 μm is employed.

Next, a description will be given of the principle of electrostatic transport of the toner in the toner carrier 42 having the above-described structure.

When the driving waveforms consisting of n phases, for example, 3 phases, are applied to the plurality of the electrodes 221 of the toner carrier 42, the plurality of the electrodes 221 generates a phase-shifting electrical field or a progressing wave electrical field.

Consequently, repulsive and/or attractive forces act on the charged toner on the toner carrier 42, causing the toner to hop and travel in the moving direction of the toner carrier 42.

Figure 14:
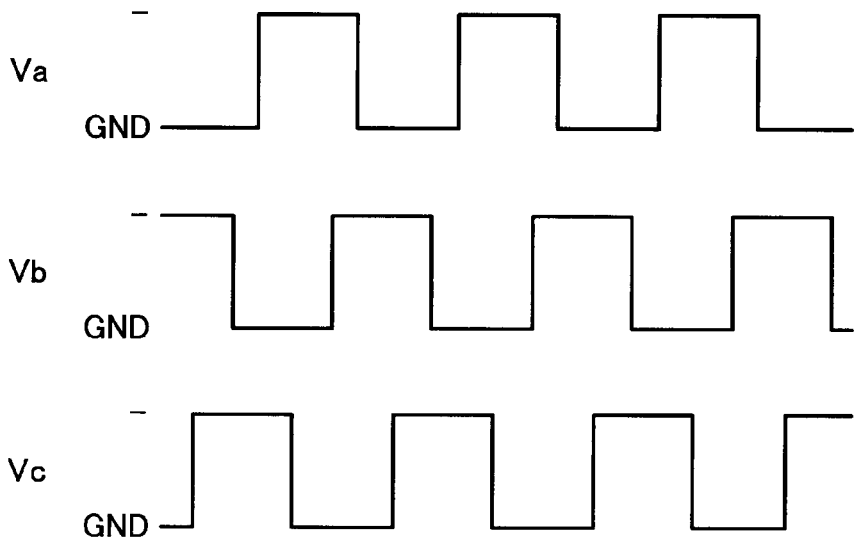
FIG. 14 is an explanatory diagram illustrating a driving voltage waveform applied to the toner carrier according to the exemplary embodiments.

For example, as shown in FIG. 14, the three-phase driving waveforms (driving signals) consisting of 3-phase pulses, phase A, phase B, and phase C, swinging between a ground voltage (0 V) and a negative voltage "–" are applied to the plurality of the electrodes 221 of the toner carrier 42 at different cycles.

Figure 15:
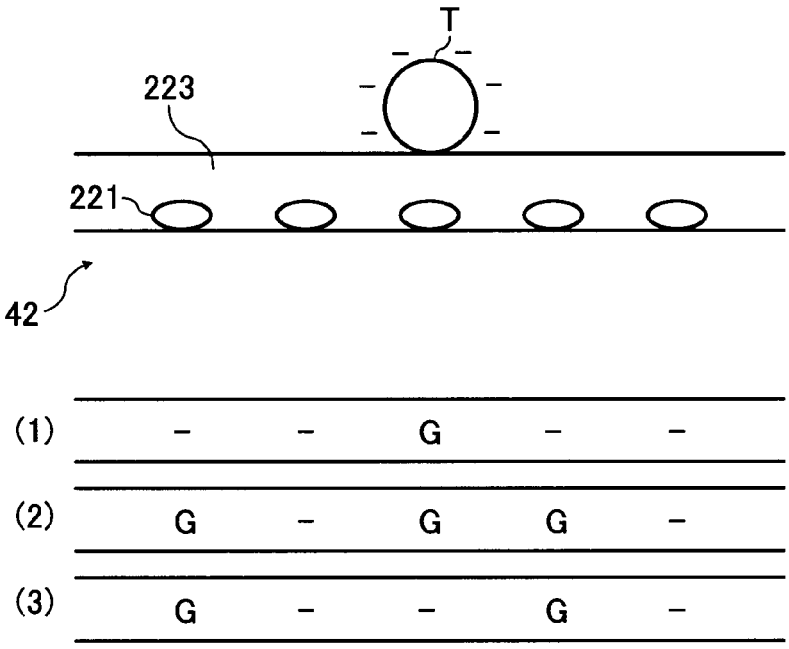
FIG. 15 is a diagram illustrating toner transport models by the driving voltage waveform according to the exemplary embodiments.

At this time, as shown in FIG. 15, the negatively charged toner T is present on the toner carrier 42 when the plurality of consecutive electrodes 221 of the toner carrier 42 is supplied with the negative "–" voltage and the ground "G" voltage in a manner shown in (1) of FIG. 15. The voltages of "–", "–", "G", "–" and "–" are applied, accordingly. The negatively charged toner T is positioned at the electrode 221 of the ground voltage "G" located in the center.

At subsequent timing, the plurality of the electrodes 221 is supplied with the voltages of "G", "–", "G", "G" and "–" as shown in (2) of FIG. 15. Consequently, the repulsive force acts between the negatively charged toner T and the electrode 221 of the negative voltage "–" on the left. The attractive force (image force) acts between the negatively charged toner T and the electrode 221 of the ground voltage "G" on the right.

Therefore, the negatively charged toner T travels to the electrode 221 of the ground voltage "G" on the right.

Furthermore, at subsequent timing, the plurality of the electrodes 221 is supplied with the voltages of "G", "–", "–", "G" and "–" as shown in (3) of FIG. 15. Consequently, the negatively charged toner T travels to the electrode 221 of the ground voltage "G" on the right.

As described above, when the multi-phase driving waveforms with varying voltages are applied to the plurality of the electrodes 221, the progressing wave electrical field is generated on the toner carrier 42, causing the negatively charged toner T to hop and travel in the moving direction of the progressing wave electrical field.

In a case of the positively charged toner, the variation pattern of the driving waveforms may be reversed so that the toner travels in the same direction described above.

Figure 16:
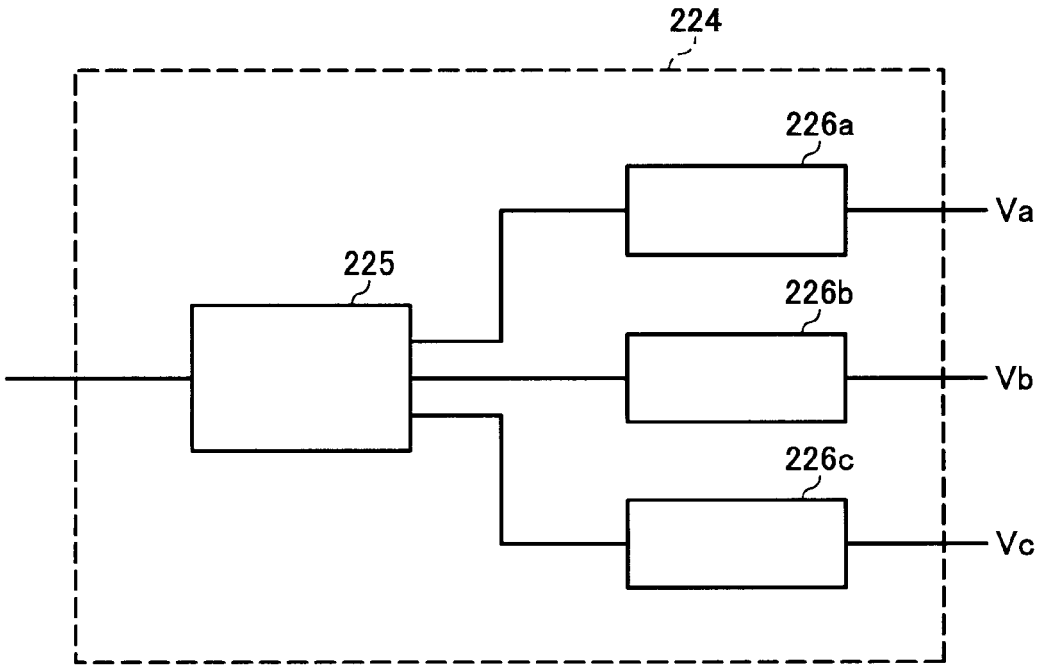
FIG. 16 is a schematic diagram illustrating a driving circuit according to the exemplary embodiments.

Referring now to FIG. 16, there is provided a block diagram illustrating a structure of the driving circuit 224 shown in FIG. 13.

The driving circuit 224 at least includes a pulse signal generating circuit 225, and waveform amplifiers 226*a*, 226*b* and 226*c*. The pulse signal generating circuit 225 generates and outputs a pulse signal.

The waveform amplifiers 226*a*, 226*b* and 226*c* input the pulse signal from the pulse signal generating circuit 225 so as to generate and output the driving waveforms Va, Vb and Vc.

When receiving an input pulse at a logic level, the pulse signal generating circuit 225 generates and outputs a certain level of pulse signal which may drive a switching mechanism, for example, a transistor, included in the waveform amplifiers 226*a, b*, and *c* at the next phase so as to perform switching between 100 and 500 V. The pulse signal includes a group of three pulses each phase-shifted at 120 degrees and is of an output voltage of 10 to 15V.

Figure 17:
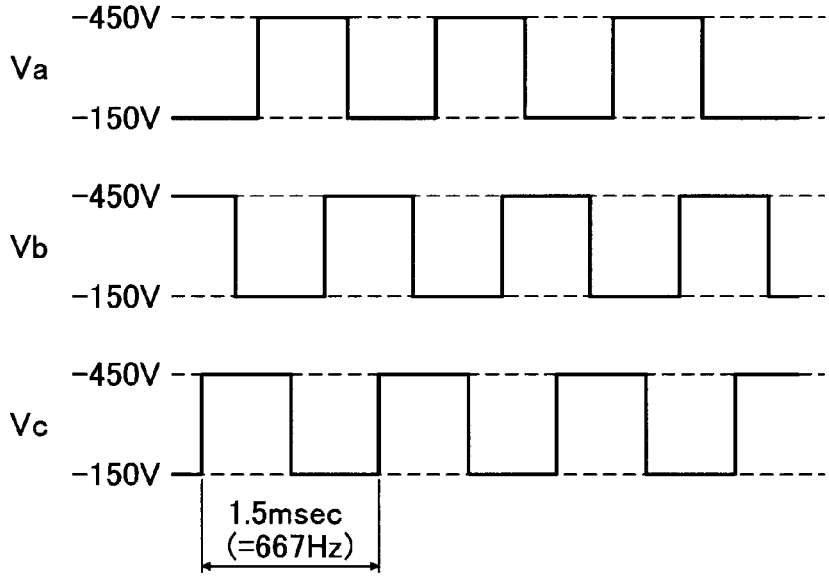
FIG. 17 is an explanatory diagram illustrating one example of a driving voltage waveform according to the exemplary embodiments.

According to the exemplary embodiments, a driving voltage as shown in FIG. 17 is applied to the three-phase electrodes 221 of the toner carrier 42.

The waveform has a peak-to-peak voltage of 300 V and is a voltage waveform in which a direct current component of –300 V is superimposed on an alternating current component with a duty ratio of 50%. According to the exemplary embodiments, the frequency of the driving voltage is 667 Hz.

In the developing region, the developing bias which triggers the development of the latent image with the toner may be a time-averaged driving voltage. In other words, the developing bias is –300 V.

When the driving voltage having such a waveform is applied to the toner carrier 42, it is possible for the toner carrier 42 to transport the toner to the developing region. Furthermore, it is possible for the toner to adhere to the image region of the developing region.

Accordingly, the driving voltage applied to the electrodes 221 causes the toner on the toner carrier 42 to be transported to the developing region. Therefore, the toner is maintained in a nonstatic state.

As described above, the amount of toner carried on the toner carrier 42 is 0.7 mg/cm$^2$.

In the developing region, the developing bias of –300 V is applied to the toner carrier 42 so that the toner adheres to the image region. At this time, the amount of toner adhered to the image region of the surface of the photoreceptor 1 is 0.7 mg/cm$^2$.

The electrode pitch of the toner carrier 42 is 150 μm because the electrode is a three-layer electrode with a pitch of 50 μm. The frequency of the driving voltage is 667 Hz. Therefore, the moving speed of the toner transported to the toner carrier 42 is 100 mm/sec.

The amount of toner on the toner carrier 42 is 0.7 mg/cm$^2$. Therefore, the amount of the toner transported on the toner carrier 42 is 7 mg/(cm·sec).

As described above, the amount of toner adhered to the photoreceptor 1 after passing the developing region is 0.7 mg/cm$^2$, and the linear velocity of the photoreceptor 1 is 100 mm/sec.

Therefore, in the image region, all of the toner carried on the toner carrier 42 is moved to the photoreceptor 1.

In other words, according to the exemplary embodiments, the adhesion amount of the toner to be developed on the photoreceptor 1 is regulated by the amount of toner carried on the toner carrier 42.

The photoreceptor 1 and the toner carrier 42 are positioned facing each other in a non-contact manner (non-contact development) so as not to disturb the toner image formed on the photoreceptor 1 when the colors are overlaid on one another on the photoreceptor 1.

The toner is carried on the toner carrier 42 in the nonstatic state. Accordingly, despite the low potential developing bias, that is, an average developing bias is −300 V, a substantial amount of toner adhesion, for example, 0.7 mg/cm$^2$, is retained on the photoreceptor 1.

As described above, in the full-color image forming apparatus according to the exemplary embodiments, the surface potential Vp1 of the photoreceptor 1 is charged to −500 V immediately after passing the first charging region 31.

Immediately after passing the second charging region 32, the surface potential Vp2 of the photoreceptor 1 is evenly charged to −400 V.

In other words, after temporarily charging the surface of the photoreceptor 1 to a substantially large potential, the chargers 2Y, 2C and 2K reduce the charge potential so as to obtain the target charge potential.

Accordingly, such an effect as to reduce the amount of charge in the toner layer formed on the photoreceptor 1 is achieved. Thus, a problem such that the amount of toner adhesion decreases when overlaying toner images is reduced, if not prevented.

According to the exemplary embodiments, such a problem that the desired colors cannot be reproduced due to the decrease in the amount of toner adhesion of the toner images to be overlaid, or the reduction of color reproduction is reduced, if not prevented, thus making it possible to achieve a high-quality color image.

In the above-described full-color image forming apparatus the effect of the present invention is explained using the corona charger 2 of the first exemplary embodiment. A similar if not identical effect may be achieved when using the corona charger 2 of the second exemplary embodiment.

In this case, the relation |Vp1|/|Vg2| between the absolute value |Vp1| of the surface potential of the photoreceptor 1 immediately after passing the first charging region 31 and the absolute value |Vg2| of the second grid potential in the second charging region 32 is preferably no less than 1.0 and no more than 2.0.

When |Vp1|/|Vg2| is 2.0 or greater, it becomes difficult to reduce the surface potential of the photoreceptor 1 to the desired potential in the second charging region 32 downstream.

Furthermore, it is preferable that |Vp1|/|Vg2| be no less than 1.2 and no more than 1.8.

Next, a description will be given of a first variation of the developing unit 4.

In the developing unit shown in FIG. 12, the toner carrier 42 is stationary. Alternatively, however, the toner carrier 42 may be formed in an endless manner and rotatable, and additionally, may be configured to connect to a drive mechanism through a gear.

During image formation, the toner carrier 42 may remain stationary and carry out a similar if not identical operation as described above. The toner carrier 42 rotates when no image is being formed. When the toner carrier 42 rotates, it does so at a periphery speed of 50 mm/sec.

The toner carrier 42 may be configured to rotate during image formation. For example, when the toner carrier 42 is rotated at 50 mm/sec during image formation, the traveling speed of the toner in the developing region is 150 mm/sec because the structure of the electrodes and the frequency of the driving voltage are similar if not identical to those of the above-described developing unit 4.

The voltage applied to the toner supply roller 43 is adjusted such that the amount of toner adhered to the toner carrier 42 is 0.47 mg/cm$^2$. The voltage applied to the space between the toner supply roller 43 and the toner carrier 42 is configured to be 1.2 kV so that the amount of toner adhered to the toner carrier 42 is 0.47 mg/cm$^2$.

When the driving voltage applied to the toner carrier 42 causes the toner to be transported, and the toner carrier 42 is rotated, more toner is transported to the developing region even if less toner carried on the toner carrier 42. The advantage here is that, when the amount of toner carried on the toner carrier 42 is less, the amount of toner to be transported is less likely to be affected by the temperature and/or humidity fluctuation, and therefore more stable toner transport is achieved.

Next, a description will be given of a second variation of the developing unit 4.

The structure of the developing unit of the second variation is substantially similar to the developing unit 4 of the first variation, except that the toner carrier 42 is endlessly formed and rotatably provided.

Furthermore, the electrodes provided to the toner carrier 42 do not generate a transport electrical field that is a progressing wave electrical field. Instead, a oscillating electrical field is formed.

Figure 18:
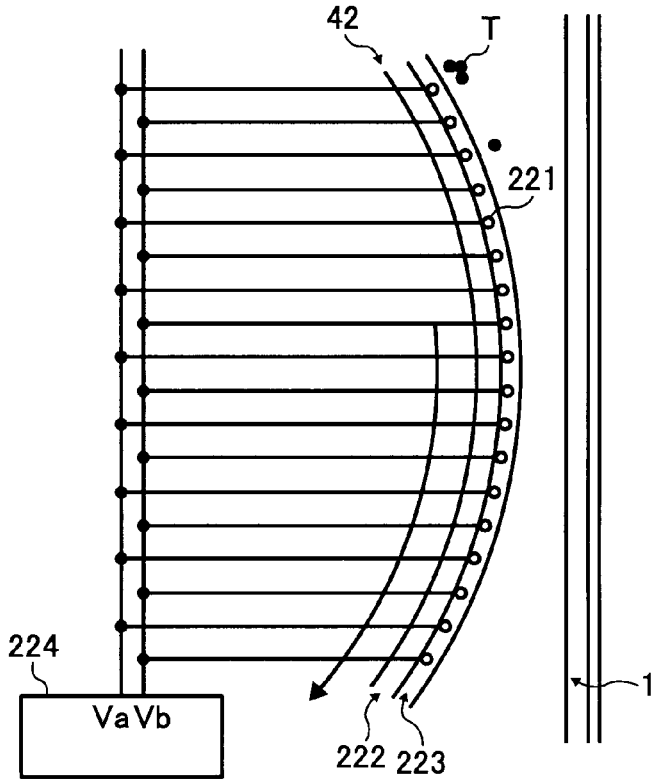
FIG. 18 is a schematic diagram illustrating the toner carrier employed in the developing unit according to a second exemplary variation.

Referring now to FIG. 18, there is shown a schematic diagram illustrating the toner carrier 42 of the second variation.

The developing unit of the second variation is configured such that, when an oscillating voltage is applied to the electrodes 221 of the toner carrier 42, the toner is carried in a nonstatic state.

The toner is not transported by the transporting electrical field but instead moves back and forth at the same position.

Furthermore, the toner carrier 42 of the developing unit of the second variation rotates at a peripheral speed of 100 mm/sec in a direction shown by an arrow in FIG. 18.

According to the second variation, the transporting electrical field formed by the electrodes 221 of the toner carrier 42 does not cause the toner to be transported to the developing region. Instead, the toner is transported to the developing region by the rotary movement of the toner carrier 42.

Figure 19:
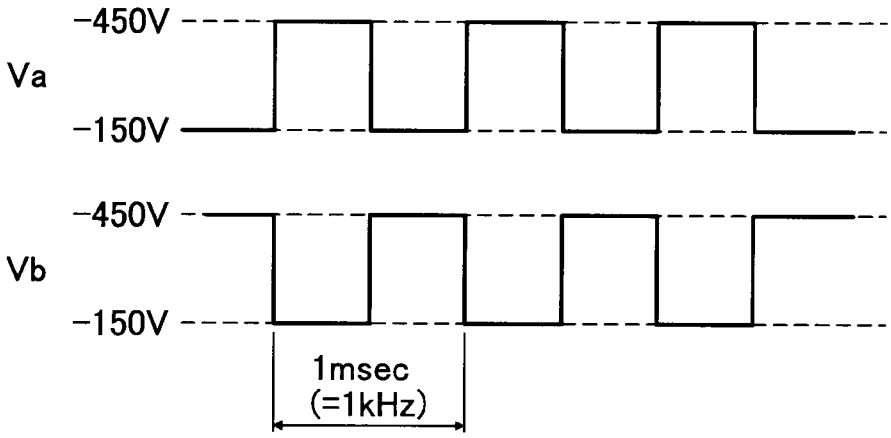
FIG. 19 is an explanatory diagram illustrating one example of a driving voltage waveform applied to the toner carrier.

In the developing unit of the second variation, the driving voltage shown in FIG. 19 is applied to two-phase electrodes 221 of the toner carrier 42.

The waveform has a peak-to-peak voltage of 300 V and is a voltage waveform in which a direct current component of −300 V is superimposed on an alternating current component with a duty ratio of 50%.

According to the exemplary embodiments, the frequency of the driving voltage is 1 kHz.

When such a driving voltage is applied, the toner on the toner carrier 42 is carried in the nonstatic state in the developing unit of the second variation.

When the toner carrier 42 rotates, the toner carried thereon is transported to the developing region.

The time-averaged driving voltage of −300 V corresponds to the developing bias. The developing bias causes the toner in the developing region to travel to the photoreceptor 1 so that the electrostatic latent image is developed.

In the developing unit of the second variation, the voltage applied to the space between the toner supply roller 43 and the toner carrier 42 is adjusted to 1.3 kV so that the amount of the toner on the toner carrier 42 becomes 0.7 mg/cm$^2$.

Accordingly, similar to the above-described developing unit 4, the same amount of toner is transported by the toner carrier 42, that is, 0.7 mg/cm$^2$. In other words, in the developing unit of the second variation, all of the toner carried on the toner carrier 42 is moved to the image region of the photoreceptor 1.

According to the corona charger 2 of the exemplary embodiments, the AC voltage superimposed on the DC voltage is applied to the corona electrode 21 so as to generate the corona discharge.

In the first charging region 31 upstream of the opening 23 of the case 22, no grid electrode is provided. Alternatively, the first grid electrode 26 having a relatively high grid potential may be provided to the first charging region 31 so that the amount of the corona charge supplied to the photoreceptor 1 increases.

Accordingly, in the first charging region 31, the substantial corona discharge is supplied to the photoreceptor 1 so that it is possible to accommodate high-speed operation.

In the second charging region 32 downstream of the opening 23, the grid electrode having an appropriate grid potential similar to the target potential of the corona electrode 21 and the photoreceptor 1 is provided. Accordingly, the grid electrode regulates the corona discharge to the photoreceptor, and the photoreceptor is evenly charged to a similar voltage as the grid voltage.

When high-speed charging ability is achieved in the first charging region 31, and the charge uniformity is achieved in the second charging region 32, both high-speed ability and charge uniformity are achieved.

The width of the opening of the corona charger 2 has a similar if not identical width as the width of the opening of a normal scorotron charger. When compared with the AC-type scorotron charger with the case having the width of the opening widened and the DC/AC double charger, the size of the corona charger 2 of the exemplary embodiments remains compact.

In other words, both charge uniformity and high-speed charging ability are achieved without increasing the size of the charger.

When no grid electrode is provided to the first charging region 31, it is possible to effectively supply corona discharge to the photoreceptor 1. Accordingly, high-speed charging ability is enhanced.

When the first grid electrode 26 having the relatively large first grid potential Vg1 is provided to the first charging region 31, high-speed charging is enhanced in the first charging region 31 while the charge uniformity is relatively enhanced when compared with the charging region without a grid electrode.

In other words, when the charge uniformity is relatively enhanced in the first charging region 31, and the substantial charge uniformity is achieved in the second charging region 32, the charge uniformity is effectively achieved.

When the surface potential of the photoreceptor 1 is raised to |Vp1| in the first charging region 31 upstream of the opening 23 of the case 22, and the grid potential in the second charging region 32 downstream of the opening 23 of the case 22 is reduced to |Vg2|, the photoreceptor 1 is temporarily charged to a high potential, and subsequently the photoreceptor 1 is discharged with the AC component.

When the corona charger 2 which applies the AC component is employed in the image forming apparatus which overlays a plurality of colors on the photoreceptor 1 to form an image, it is possible to reduce the size of the charge in the toner layer formed on the photoreceptor 1.

Accordingly, it is possible to reduce the reduction in the amount of toner in the toner images overlaid on one another without increasing the size of the charger.

Thus, such problems that the desired colors cannot be reproduced due to the reduction of the amount of toner adhesion of the toner images to be overlaid, and/or the reduction of color reproduction are reduced, if not prevented. Therefore, it is possible to achieve a high-quality color image.

When the charge uniformity is no more than 5 V, the output image is most likely not affected in the normal image forming apparatus, thereby allowing a high-quality image output.

In the corona charger 2, according to the above-described experiments, when the value of W2/W is no less than 0.5 and less than 1.0, where W represents an entire width of the opening of the corona charger 2 (W=W1+W2), W1 is the width of the opening of the first charging region 31, and W2 is the width of the opening of the second charging region 32, it is possible to achieve relatively small charge uniformity (not greater than 5 V).

In other words, the small fluctuation of the charge potential in the longitudinal direction, that is, no more than 5 V, is achieved when the following relation is satisfied: W1<W2, where W1 is the width of the opening of the first charging region 31, and W2 is the width of the opening of the second charging region 32.

In order to enhance high-speed charging ability, the opening density of the grid is configured to be relatively large so that the amount of the corona discharge which flows in the grid electrode is less, and the amount of discharge supplied to the photoreceptor 1 increases.

However, when the opening density is too large, the charge uniformity of the photoreceptor 1 is degraded.

When a relation ρ1>ρ2 is satisfied, where ρ1 is the opening density of the first grid electrode 26 upstream of the opening 23, and ρ2 is the opening density of the second grid electrode 27 downstream of the opening 23, it is not necessary to realize the precise high-speed charging ability at the first grid electrode 26.

Instead, the photoreceptor 1 is charged to the value near the target value so that high-speed charging ability is enhanced. Subsequently, the charge uniformity is achieved at the second grid electrode 27.

The corona charger 2 may be employed in the image forming apparatus which overlays toner images of different colors on the photoreceptor 1 to form an image. For the image forming apparatus having a limited space around the photoreceptor 1, it is advantageous to use the corona charger 2 which accommodates the high-charging ability and the charge uniformity with a small structure.

Furthermore, the photoreceptor 1 can be temporarily charged to the potential greater than the target potential at a position upstream the corona charger 2, and the photoreceptor 1 can be discharged to the target potential at a position downstream of the corona charger 2.

Accordingly, the amount of the charge in the toner image formed on the photoreceptor 1 is reduced so that it is possible to reduce the reduction of the amount of adhesion of the toner image. Thus, it is possible to obtain the high-quality image.

The toner carrier 42 of the developing unit 4 employed in the image forming apparatus carries the toner in a nonstatic manner. Accordingly, the adhesion between the toner and the toner carrier 42 is relatively small.

Development is finished when the potential of the photoreceptor 1 in the state where the toner is adhered to the photoreceptor 1 becomes similar to, if not the same as, the developing bias. In other words, development at a low potential is made possible.

In a state where the toner layer has been formed on the photoreceptor 1, a relatively large developing bias is necessary to further overlay toner layers on the photoreceptor 1.

When the corona charger 2 of the exemplary embodiments is employed, the size of the charge of the toner image formed on the photoreceptor 1 is reduced. Accordingly, it is possible to reduce the decrease in the adhesive amount.

However, there are two other cases causing the decrease in the amount of the toner adhesion when another toner layer is formed on top of the toner layer.

One case is that the already existing toner layer absorbs light for writing, causing the potential after exposure to increase. The other case is that the amount of developing toner decreases when the increase in potential at the time the toner adheres expands due to the thickness of the toner layer.

In order to obtain the same amount of toner adherence as the toner adherence of the already existing toner layer, the developing bias needs to be increased. Therefore, in the image forming apparatus, the developing bias needs to be increased as more toner layers are overlaid on one another.

For this reason, it is necessary to increase discharge from the toner carrier 42 to the photoreceptor 1, as well as increase insulation of the developing unit 4.

In the developing unit of the exemplary embodiments, the toner on the toner carrier 42 is carried in a nonstatic state so that it is possible to reduce the developing bias needed for a single color.

When the corona charger 2 and the toner carrier 42 which carries the toner in a nonstatic state are employed in the image forming apparatus, it is possible to effectively reduce the reduction of the amount of toner adhesion of the toner images to be overlaid.

Accordingly, such problems that the desired colors cannot be reproduced due to the decrease in the amount of toner adhesion of the toner images to be overlaid, and/or the reduction of color reproduction are reduced, if not prevented. Therefore, it is possible to obtain a high-quality image.

The toner carrier 42 includes the plurality of electrodes 221 disposed at predetermined intervals. The multi-phase voltage is applied to the plurality of electrodes 221 so that the progressing wave electrical field is formed between the plurality of electrodes 221. The progressing wave electrical field causes the toner to hop on the toner carrier 42 while transporting the toner to the position opposite the photoreceptor.

Accordingly, the toner is carried on the toner carrier 42 in the nonstatic state.

In addition, the toner carrier 42 is employed without being driven so that it is possible to reduce, if not prevent, contamination of the inside of the apparatus caused by toner leakage or adherence of toner to the image.

When there are a number of driven portions abrading each other, the toner tends to leak from the abrading portion. However, because the toner carrier 42 is in a stationary state, abrasion does not readily occur.

Furthermore, the toner carrier 42 is not driven, and therefore it is easy to maintain the distance between the photoreceptor 1 and the toner carrier 42 at a certain distance, thereby providing enhanced mechanical design flexibility.

Furthermore, the toner carrier may use the above-described progressing wave electrical field to transport the toner to the position opposite the photoreceptor 1 while moving the surface of the toner carrier 42.

In the developing unit 4, the toner is carried and transported by the progressing wave electrical field formed between the plurality of the electrodes 221 while the surface movement of the toner carrier 42 transports the toner to the position opposite the photoreceptor 1.

When forming an image, the toner carrier 42 is at rest. When image formation is not performed, the surface of the toner carrier 42 moves. Therefore, even if a problem occurs at the place opposite the photoreceptor 1, such toner carrier can relocate the place with the problem and cause the normal portion to face to the photoreceptor 1. Therefore, it may be less necessary to often replace the toner carrier 42.

Alternatively, when the surface movement of the toner carrier 42 is performed during image formation, the toner is transported by the surface movement of the toner carrier 42 as well as by the progressing wave electrical field.

When the surface movement of the toner carrier 42 is added, more toner can be transported to the developing region even if less toner is carried on the toner carrier 42. The advantage is that, when less toner is carried on the toner carrier 42, the amount of the toner to be transported is less likely to be affected by temperature and/or humidity fluctuation, providing more stable toner transport.

Furthermore, the toner may be carried on the toner carrier 42 in a nonstatic state by using the oscillating electrical field formed between the plurality of the electrodes 221 disposed at predetermined intervals to which the multi-phase voltage is applied.

In addition, the surface movement of the toner carrier 42 transports the toner thereon to the place opposite the photoreceptor 1.

In the developing unit 4, the oscillating electrical field formed between the plurality of the electrodes 221 causes the toner to move back and forth at the same position without being transported. Consequently, the toner is carried in a nonstatic state on the surface of the toner carrier 42. On average, the toner stays at the same position on the toner carrier 42.

When the surface of the toner carrier 42 moves, the toner is transported to the developing region.

Thus, as described above, the electrical field does not transport the toner, and therefore the problem of foreign substances adhering to the toner carrier 42 is reduced if not eliminated. Consequently, such a problem that the toner is caught by the foreign substances and does not move further downstream is reduced if not eliminated.

Accordingly, it is possible to provide a developing unit which may reduce if not prevent adherence of foreign substances to the toner carrier 42. Furthermore, the toner carrier 42 may carry various amounts of toner on the surface.

Accordingly, high-quality color images may be obtained when the toner carrier is employed in the image forming apparatus equipped with the developing units for four colors, cyan, magenta, yellow and black.

Elements and/or features of different exemplary embodiments described above may be combined with each other and/or substituted for each other within the scope of this disclosure and the appended claims.

Still further, any one of the above-described and other exemplary features of the present invention may be embodied in the form of an apparatus, method, system, computer program, or computer program product. For example, any of the aforementioned methods may be embodied in the form of a system or device, including, but not limited to, any of the structure for performing the methodology illustrated in the drawings.

One or more embodiments of the present invention may be conveniently implemented using a conventional general purpose digital computer programmed according to the teachings of the present specification, as will be apparent to those skilled in the computer art.

Appropriate software coding can readily be prepared by skilled programmers based on the teachings of the present disclosure, as will be apparent to those skilled in the software art.

One or more embodiments of the present invention may also be implemented by the preparation of application specific integrated circuits or by interconnecting an appropriate network of conventional component circuits, as will be readily apparent to those skilled in the art.

Any of the aforementioned methods may be embodied in the form of a system or device, including, but not limited to, any of the structure for performing the methodology illustrated in the drawings.

Furthermore, any of the aforementioned methods may be embodied in the form of a program. The program may be stored on a computer readable media and adapted to perform any one of the aforementioned methods when run on a computer device (a device including a processor).

Thus, the storage medium or computer readable medium is adapted to store information and is adapted to interact with a data processing facility or computer device to perform the method of any of the above mentioned embodiments.

The storage medium may be a built-in medium installed inside a computer device main body or a removable medium arranged so that it can be separated from the computer device main body. Examples of a built-in medium include, but are not limited to, rewriteable non-volatile memories, such as ROMs and flash memories, and hard disks.

Examples of a removable medium include, but are not limited to, optical storage media such as CD-ROMs and DVDs; magneto-optical storage media, such as MOs; magnetism storage media, such as floppy disks (trademark), cassette tapes, and removable hard disks; media with a built-in rewriteable non-volatile memory, such as memory cards; and media with a built-in ROM, such as ROM cassettes.

Example embodiments being thus described, it will be obvious that the same may be varied in many ways. Such exemplary variations are not to be regarded as a departure from the spirit and scope of the present invention, and all such modifications as would be obvious to one skilled in the art are intended to be included within the scope of the following claims.

The number of constituent elements, locations, shapes and so forth of the constituent elements are not limited to any of the structure for performing the methodology illustrated in the drawings.

What is claimed is:

1. A corona charger, comprising:

a case provided in the vicinity of the device to be charged, including an opening facing the device;

a discharge electrode provided inside the case and supplied with a voltage so as to generate a corona discharge, and configured to charge a surface of the device from the opening by supplying the corona discharge to the surface;

a first charging region including a first grid electrode to which a predetermined voltage is applied at a position upstream of the opening in the surface moving direction of the device and charged to a first grid potential (Vg1); and a second charging region including a second grid electrode to which a predetermined voltage is applied at a position downstream of the opening and charged to a second grid potential (Vg2) substantially near a target charge potential of the device, wherein the voltage applied to the discharge electrode is an alternating current (AC) voltage superimposed on a direct current (DC) voltage, and wherein both of the following relations are satisfied:

$$|Vg1|>|Vg2| \text{ and}$$

$$|Vp1|>|Vg2|,$$

wherein |Vg1| is an absolute value of the first grid potential, |Vg2| is an absolute value of the second grid potential, and |Vp1| is an absolute value of a surface potential of the device after passing the first charging region.

2. The corona charger according to claim 1, wherein the following relation is satisfied:

$$W1<W2,$$

wherein W1 is an width of the opening of the first charging region, and W2 is an width of the opening of the second charging region.

3. The corona charger according to claim 1, wherein the following relation is satisfied:

$$\rho1>\rho2,$$

wherein ρ1 is an opening density of the first grid electrode per unit area, and ρ2 is an opening density of the second grid electrode per unit area.

4. An image forming apparatus, comprising:

an image carrier configured to bear a toner image;

a plurality of chargers configured to charge the image carrier;

an exposure unit configured to expose the image carrier to form an electrostatic latent image thereon;

a plurality of developing units configured to develop a plurality of electrostatic latent images on the image carrier to form a plurality of overlaid toner images, each one of the plurality of developing units including a toner carrier; and a transfer unit configured to transfer the overlaid toner images on the image carrier to a transfer medium all at once, at least one of the plurality of chargers comprising:

a case provided in the vicinity of a device to be charged, including an opening facing the device;

a discharge electrode provided inside the case and supplied with a voltage so as to generate a corona discharge, and configured to charge a surface of the device from the opening by supplying the corona discharge to the surface;

a first charging region including a first grid electrode to which a predetermined voltage is applied at a position upstream of the opening in the surface moving direction of the device and charged to a first grid potential; and a second charging region including a second grid electrode to which a predetermined voltage is applied at a position downstream of the opening and charged to a second grid potential (Vg2) substantially near a target charge potential of the device, wherein the voltage applied to the discharge electrode is an alternating current (AC) voltage superimposed on a direct current (DC) voltage, and wherein both of the following relations are satisfied:

$$|Vg1|>|Vg2| \text{ and}$$

$$|Vp1|>|Vg2|,$$

wherein |Vg1| is an absolute value of the first grid potential, |Vg2| is an absolute value of the second grid potential, and |Vp1| is an absolute value of a surface potential of the device after passing the first charging region.

5. The image forming apparatus according to claim 4, wherein the toner carrier bears toner in a nonstatic state.

6. The image forming apparatus according to claim 4, wherein the toner carrier comprises:

a plurality of electrodes disposed at predetermined intervals; and a power source configured to apply a multi-phase voltage to the electrodes so as to form a progressing wave electrical field, wherein the toner carrier bears the toner by way of the progressing wave electrical field and transports the toner to a position opposite the image carrier.

7. The image forming apparatus according to claim 6, the toner carrier further comprising a surface configured to be movable, wherein the toner carrier bears the toner by way of the progressing wave electrical field and transports the toner to the position opposite the image carrier by moving the surface.

8. The image forming apparatus according to claim 4, wherein the toner carrier comprises:

a plurality of electrodes disposed at predetermined intervals;

a power source configured to apply a voltage to the electrodes so as to form a oscillating electrical field; and a surface configured to be movable, wherein the toner carrier bears the toner in a nonstatic state by way of the oscillating electrical field, and transports the toner to the position opposite the image carrier by moving the surface.

9. The image forming apparatus according to claim 4, wherein the plurality of developing units comprises four developing units configured to form toner images of cyan, magenta, yellow, and black, respectively.

10. The image forming apparatus of claim 4, wherein the following relation is satisfied:

$$W1<W2,$$

wherein W1 is an width of the opening of the first charging region, and W2 is an width of the opening of the second charging region.

11. The image forming apparatus of claim 4, wherein the following relation is satisfied:

$$\rho 1>\rho 2,$$

wherein ρ1 is an opening density of the first grid electrode per unit area, and ρ2 is an opening density of the second grid electrode per unit area.

* * * * *